US012279726B2

(12) United States Patent
Bodman

(10) Patent No.: US 12,279,726 B2
(45) Date of Patent: Apr. 22, 2025

(54) ADJUSTABLE TOILET SEAT RISER AND METHOD OF USE THEREOF

(71) Applicant: MOBB HEALTH CARE LTD CORPORATION, Concord (CA)

(72) Inventor: Moshe Bodman, Toronto (CA)

(73) Assignee: Mobb Health Care Ltd Corporation (CA)

( * ) Notice: Subject to any disclaimer, the term of this patent is extended or adjusted under 35 U.S.C. 154(b) by 0 days.

(21) Appl. No.: 18/642,971

(22) Filed: Apr. 23, 2024

(65) Prior Publication Data

US 2024/0349957 A1 Oct. 24, 2024

Related U.S. Application Data

(60) Provisional application No. 63/461,346, filed on Apr. 24, 2023.

(51) Int. Cl.
*A47K 13/00* (2006.01)

(52) U.S. Cl.
CPC ..... *A47K 13/005* (2013.01)

(58) Field of Classification Search
CPC ..... A47K 13/005; A47K 13/06; A47K 13/28
USPC ..... 4/234–241, 245.1, 245.3, 245.7, 245.9, 4/902
See application file for complete search history.

(56) References Cited

U.S. PATENT DOCUMENTS

| | | | | |
|---|---|---|---|---|
| 8,316,472 | B1 * | 11/2012 | Martin | A47K 13/24 4/235 |
| 11,647,874 | B2 * | 5/2023 | Aparicio | A47K 13/005 4/239 |
| 2004/0025234 | A1 * | 2/2004 | Moser | A47K 13/005 4/237 |
| 2006/0085899 | A1 * | 4/2006 | Coles | A47K 13/24 4/237 |
| 2015/0359392 | A1 * | 12/2015 | Richmond | A47K 13/02 4/237 |
| 2022/0047129 | A1 * | 2/2022 | Van Varick | A47K 13/005 |

FOREIGN PATENT DOCUMENTS

| | | | |
|---|---|---|---|
| ES | 2939073 | A1 * | 4/2023 |
| JP | 2007151981 | A * | 6/2007 |

* cited by examiner

*Primary Examiner* — Tuan N Nguyen
(74) *Attorney, Agent, or Firm* — Greg M. Popowitz; Assouline & Berlowe, P.A

(57) ABSTRACT

An adjustable toilet seat riser, including an upper seat with an upper seat bridge, a lower platform including a lower platform bridge and at least one sleeve, and a spring, where the spring is internally positioned in the upper seat bridge and the lower platform bridge when upper seat is secured to lower platform. A method of installing an adjustable toilet seat riser on a toilet, including, compressing two arms of the adjustable toilet seat riser, relaxing the two arms of the adjustable toilet seat riser when positioned on a toilet, and engaging at least one sleeve on the adjustable toilet seat riser to an inner rim of the toilet.

16 Claims, 37 Drawing Sheets

ADJUSTABLE TOILET SEAT RISER AND METHOD OF USE THEREOF

REFERENCE TO RELATED APPLICATIONS

This patent application claims the benefit under 35 U.S.C. § 119 (e) of U.S. Provisional Patent Application No. 63/461,346, filed Apr. 24, 2023, which application is incorporated herein by reference.

BACKGROUND OF THE INVENTION

Toilet seat risers or raised toilet seats are devices to improve the accessibility and comfort of toilets for the general public, tall people, people with disabilities, post-surgical patients, and people with medical issues. Toilet seat risers assist people in wheelchairs move onto a toilet and prevent falls.

Toilet seats are often hinged units that include a round or elongated (oval) open seat and lid. The toilet seat is secured to a toilet using bolts or other fasteners that pass through holes in the rear portion of the toilet. Toilet seats include a seat itself, which can be contoured for the user to sit on, and a lid, which covers the toilet when the toilet seat is not in use. Lids are an optional add on for a toilet seat.

Most toilets include two holes in the back of the toilet, at a flat surface on the same plane as the top of the toilet bowl. The holes pass through the rear platform of the toilet. Toilet seats include connection mechanisms at the rear of the toilet seat. The connection mechanisms are often hinged relative to the toilet seat itself. The toilet seat connection mechanisms have fasteners that align to the holes in the toilet. Bolts or screws, usually plastic in material, are used to secure the toilet seat to the toilet.

Current connection mechanisms (clamping or screws/bolts) make it difficult to remove the toilet seat from the toilet for cleaning. Over time, the toilet area accumulates debris (urine and/feces) on the toilet and the toilet seat. This accumulation is unhygienic. The debris is particularly hard to clean at the connection mechanisms. When cleaning the toilet seat, most users fail or are unable to remove the debris at the connection points. To fully clean the toilet, the user would need to remove the toilet seat from the toilet by loosening the fasteners. In some cases, the fasteners are not easily removable or retightened after cleaning. This lack of access adds to the lack of hygiene for current toilet seat risers.

Current toilet seat risers use a connection mechanism that is not effective to stabilize the toilet seat riser on the toilet. Often, the toilet seat moves laterally when the user sits on the toilet seat or when the user is already seated on the toilet seat and adjusts their position. This movement of the toilet seat relative to the toilet causes added stress on the connection mechanisms between the toilet seat and the toilet, which routine causes the connection mechanism to break. This creates an unsafe condition for the user as the user can easily slide off the toilet and injure herself.

Toilets also vary in size and shape. Toilet seats are design to fit specific sizes and contours of toilets. This complexity adds to the production and stocking complexity of toilet seats that need to fit on specific toilets. A toilet seat riser is needed that will accommodate a multitude of toilet sizes and shapes.

As can be derived from the variety of devices and methods directed at providing comfort and medical advantages to toilet seats, many means have been contemplated to accomplish the desired end, i.e., an adjustable universal toilet seat riser. There is a long-felt need for a singular toilet seat riser that is adjustable to fit toilet bowls of varying widths and shapes without being limited by a fastener based connection. There is a further long-felt need for a toilet that is adjustable to secure to the toilet using the inside rim of the toilet, as opposed to connections between the toilet seat to the toilet at the rear of the toilet.

BRIEF STATEMENT OF THE INVENTION

The invention broadly relates to a toilet seat riser adjustable to fit toilets of varying widths, lengths, and shapes, and method of using the toilet seat riser on a toilet.

SUMMARY OF THE INVENTION

The present invention broadly includes an adjustable toilet seat riser with an upper seat with an upper seat bridge, a lower platform that includes a lower platform bridge, and at least one sleeve, and a spring, where the spring is internally positioned in the upper seat bridge and the lower platform bridge when upper seat is secured to lower platform.

The present invention also includes an adjustable toilet seat riser, including a spring positioned within an assembled bridge of the adjustable toilet seat riser, at least one sleeve on the inner portion of the adjustable toilet seat riser, and two arms extending from the assembled bridge, where the adjustable toilet seat riser is flexible at the assembled bridge.

In a further embodiment, a method of installing an adjustable toilet seat riser on a toilet, including compressing two arms of the adjustable toilet seat riser, relaxing the two arms of the adjustable toilet seat riser when positioned on a toilet, and engaging at least one sleeve on the adjustable toilet seat riser to an inner rim of the toilet.

OBJECT OF THE INVENTION

It is a general object of the present invention to provide an adjustable toilet seat riser that is secured to a toilet using the spring force of the assembled bridge exerting force on the assembled arms into the inner rim of the toilet.

These and other objects and advantages of the present invention will be readily appreciable from the following description of preferred embodiments of the invention and from the accompanying drawings and claims.

BRIEF DESCRIPTION OF FIGURES

The nature and mode of operation of the present invention will now be more fully described in the following detailed description of the invention taken with the accompanying drawing figures, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "toilet seat" is synonymous with terms such as "toilet seat cushion", "toilet seat topper", "toilet eat riser", etc., and such terms may be used interchangeably as appearing in the specification and claims. Although any methods, devices or materials similar or equivalent to those described herein can be used in the practice or testing of the invention, the preferred methods, devices, and materials are now described.

First Embodiment—Adjustable Toilet Seat Riser

Figure 7:
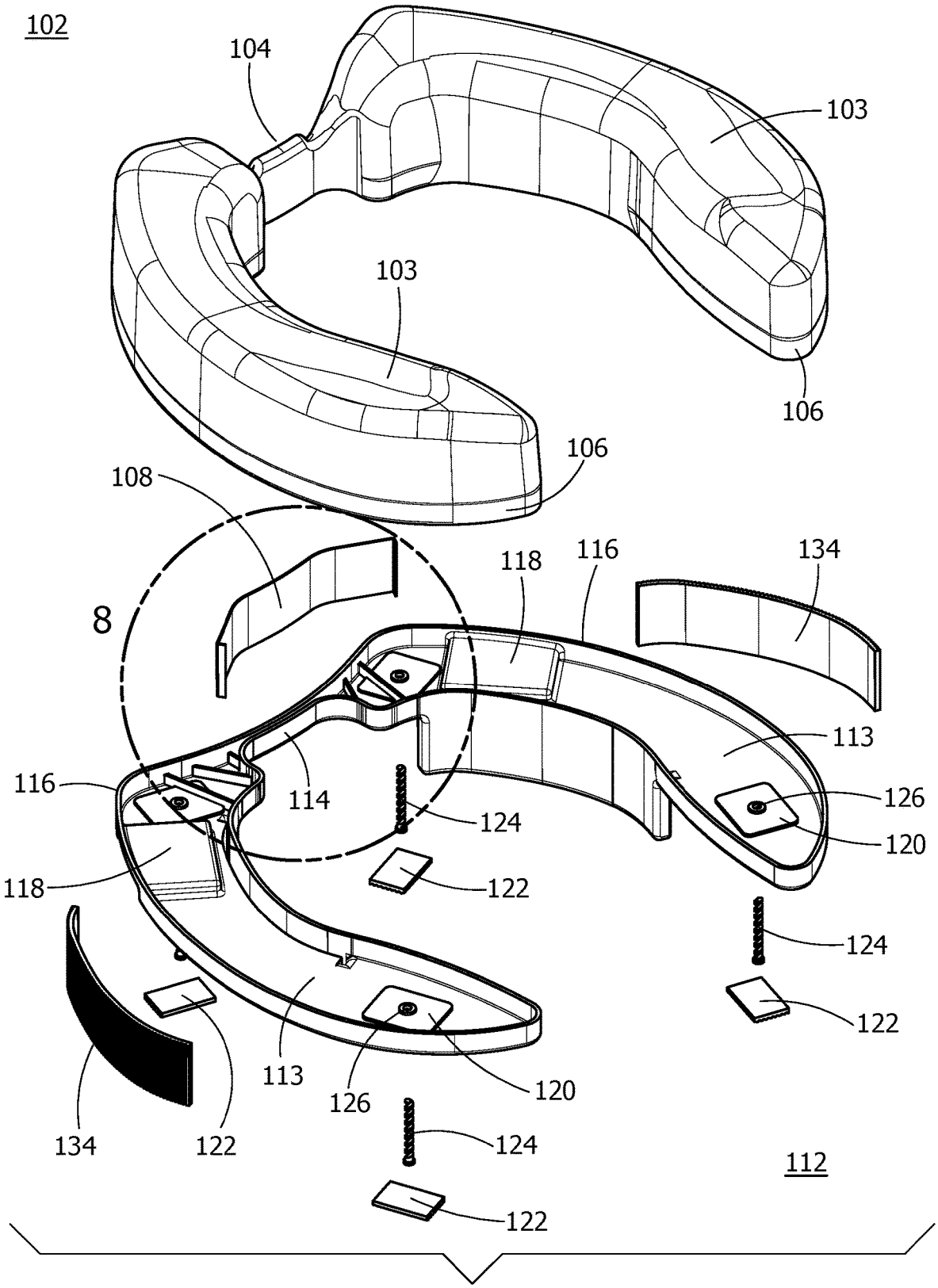
FIG. 7 is a front top perspective exploded view of the adjustable toilet seat riser in FIG. 1.
Figure 8:
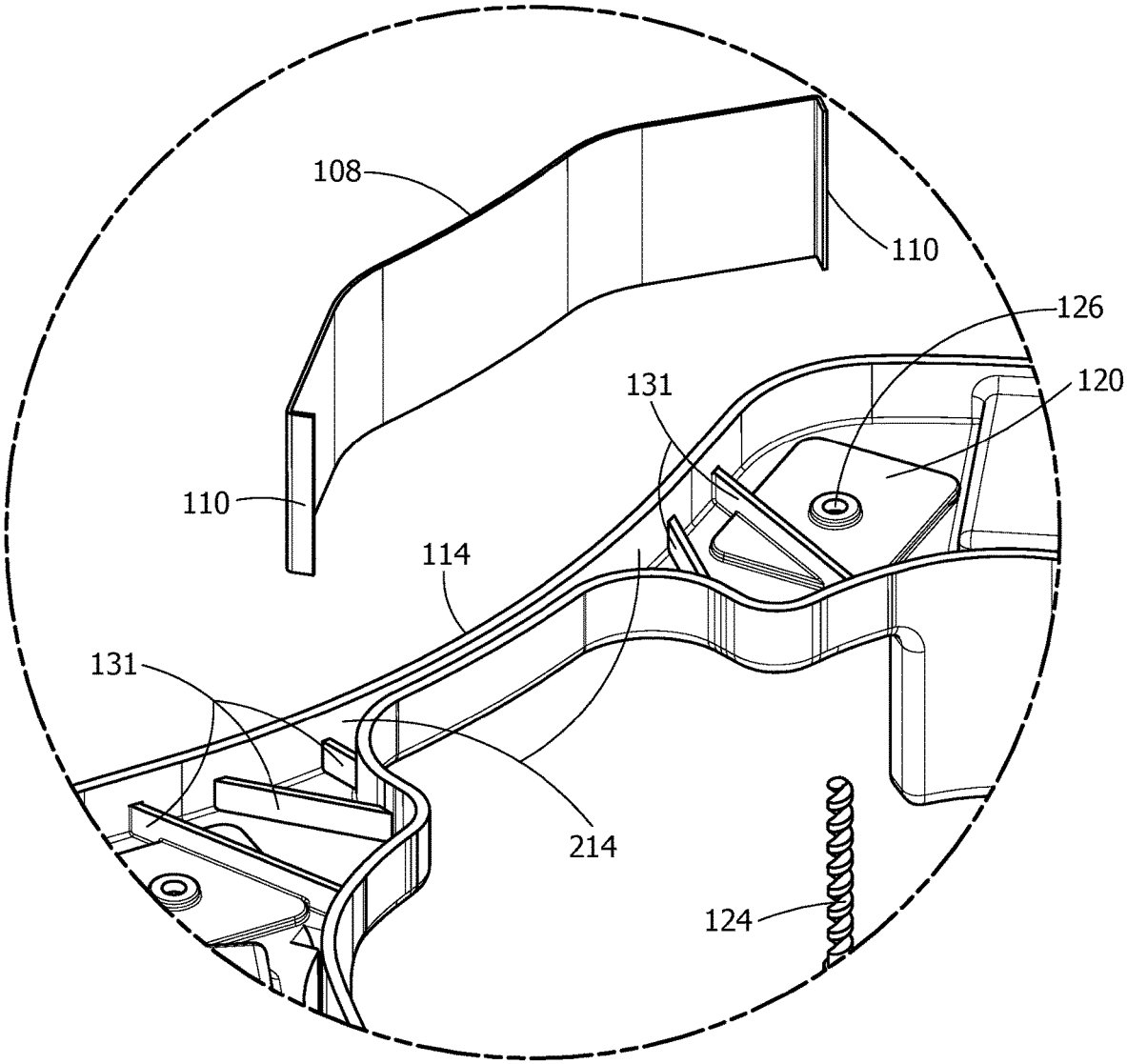
FIG. 8 is a zoomed in section of the spring and lower platform spring housing shown in FIG. 7.
Figure 9A:
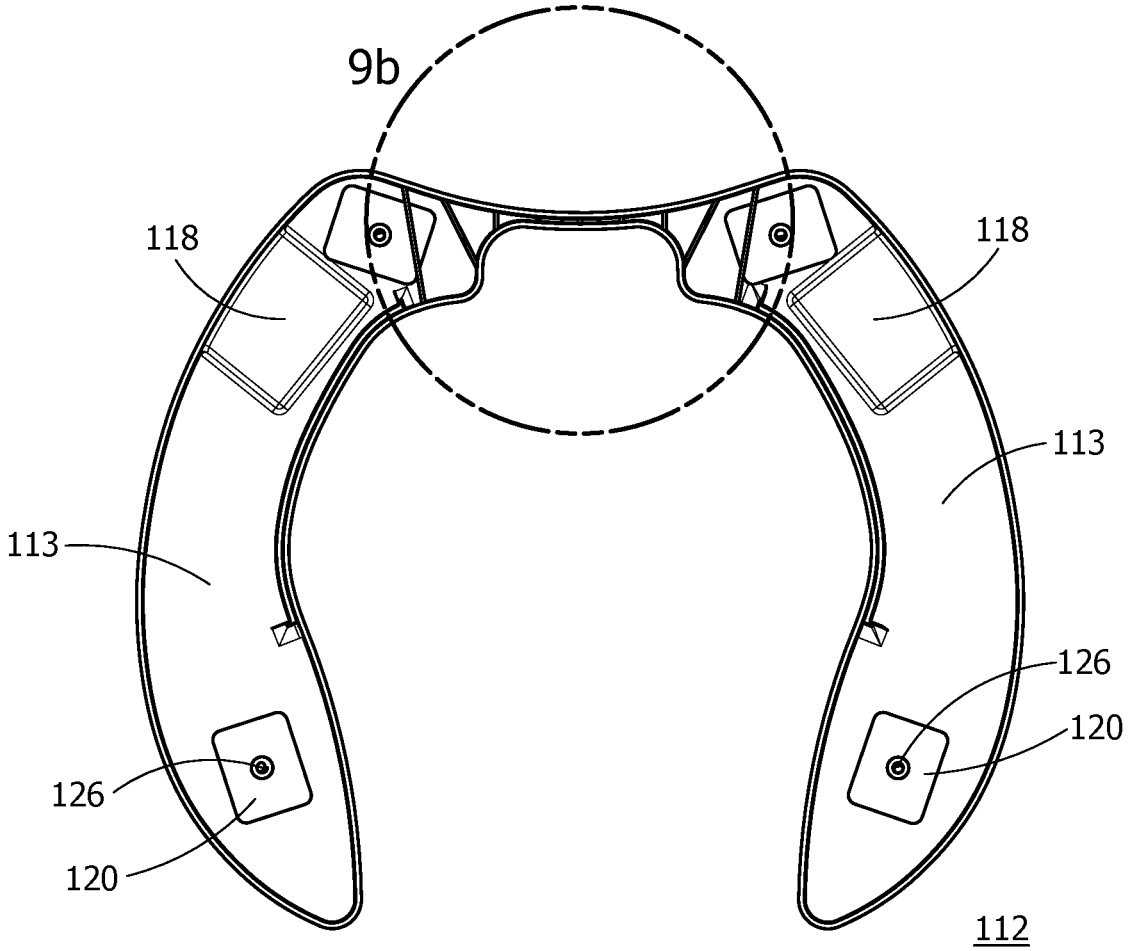
FIG. 9*a* is a bottom view of the lower platform of the adjustable toilet seat riser in FIG. 1.
Figure 9B:
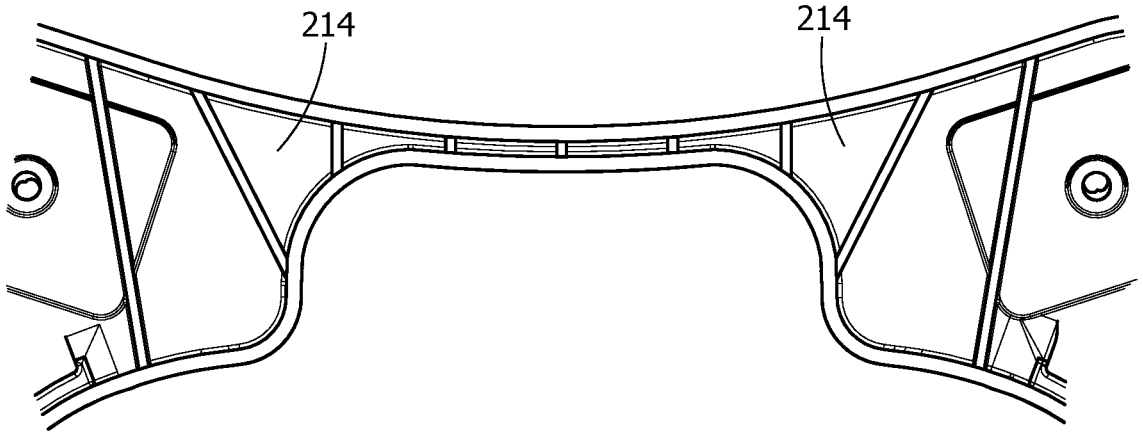
FIG. 9*b* is a zoomed in section of the lower platform spring housing of the lower platform shown in FIG. 9*a*.

Adverting now to the figures, FIGS. 1-4, 5*a*, 5*b*, 6*a*, and 6*b* show an adjustable toilet seat riser 100. FIG. 7 shows that the adjustable toilet seat riser 100 includes an upper seat 102, spring 108, and lower platform 112. As depicted in the figures, both upper seat 102 and lower platform 112 include arms that follow the path of the other. FIG. 8 shows a zoomed in section of the lower platform spring housing 214 (at the lower platform bridge 114) before insertion of spring 108.

Upper seat 102 includes two upper seat arms 103 that extend from upper seat bridge 104. Upper seat 102 forms a C or U shape, where the ends of upper seats arms 103 include an opening, which is a standard opening on toilet seats. The top edges of upper seat arms 103, along with upper seat bridge 104, include rounded or contoured edges. These rounded edges reduce sharp edges on the top surface of the upper seat 102 where the user sits when sitting on the adjustable toilet seat riser 100.

Lower platform 112 includes two lower platform arms 113 that extend from lower platform bridge 114. Lower platform 112 forms a C or U shape, where the ends of lower platform arms 113 include an opening, which is a standard opening on toilet seats. The C or U shape is a substantially curvilinear profile.

The bottom edge of upper seat 102 includes upper seat connection surface 106. The upper edge of lower platform 112 includes lower platform connection surface 116. When joining upper seat 102 to lower platform 112, upper seat connection surface 106 and lower platform connection surface 116 provide a guide to properly position upper seat 102 to lower platform 112. The profiles of the bottom of upper seat 102 and top portion of lower platform 112 follow each other to allow for proper alignment. Upper seat connection surface 106 and lower platform connection surface 116 is an optional feature as there are alternative ways to join or form upper seat 102 to lower platform 112.

Figure 1:
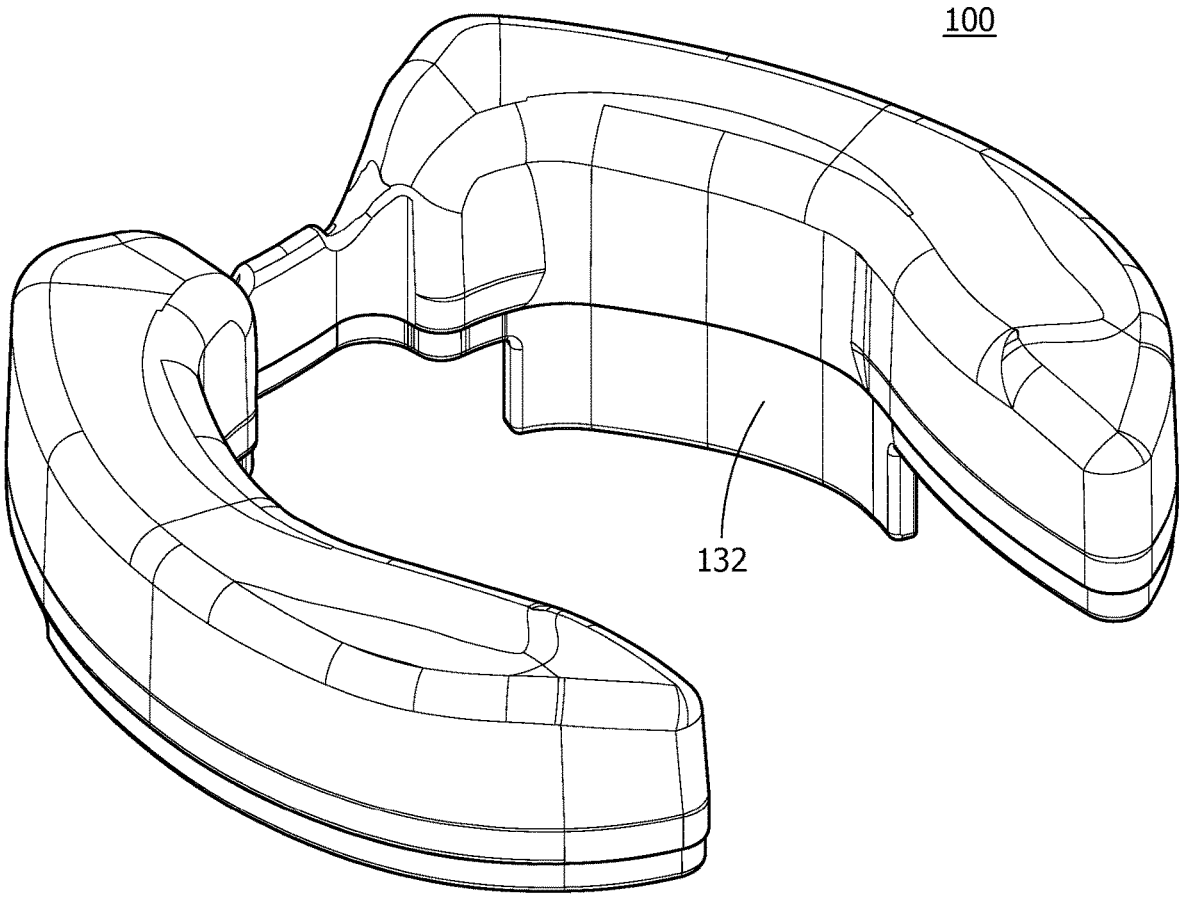
FIG. 1 is a front top perspective view of a first embodiment of an adjustable toilet seat riser.
Figure 2:
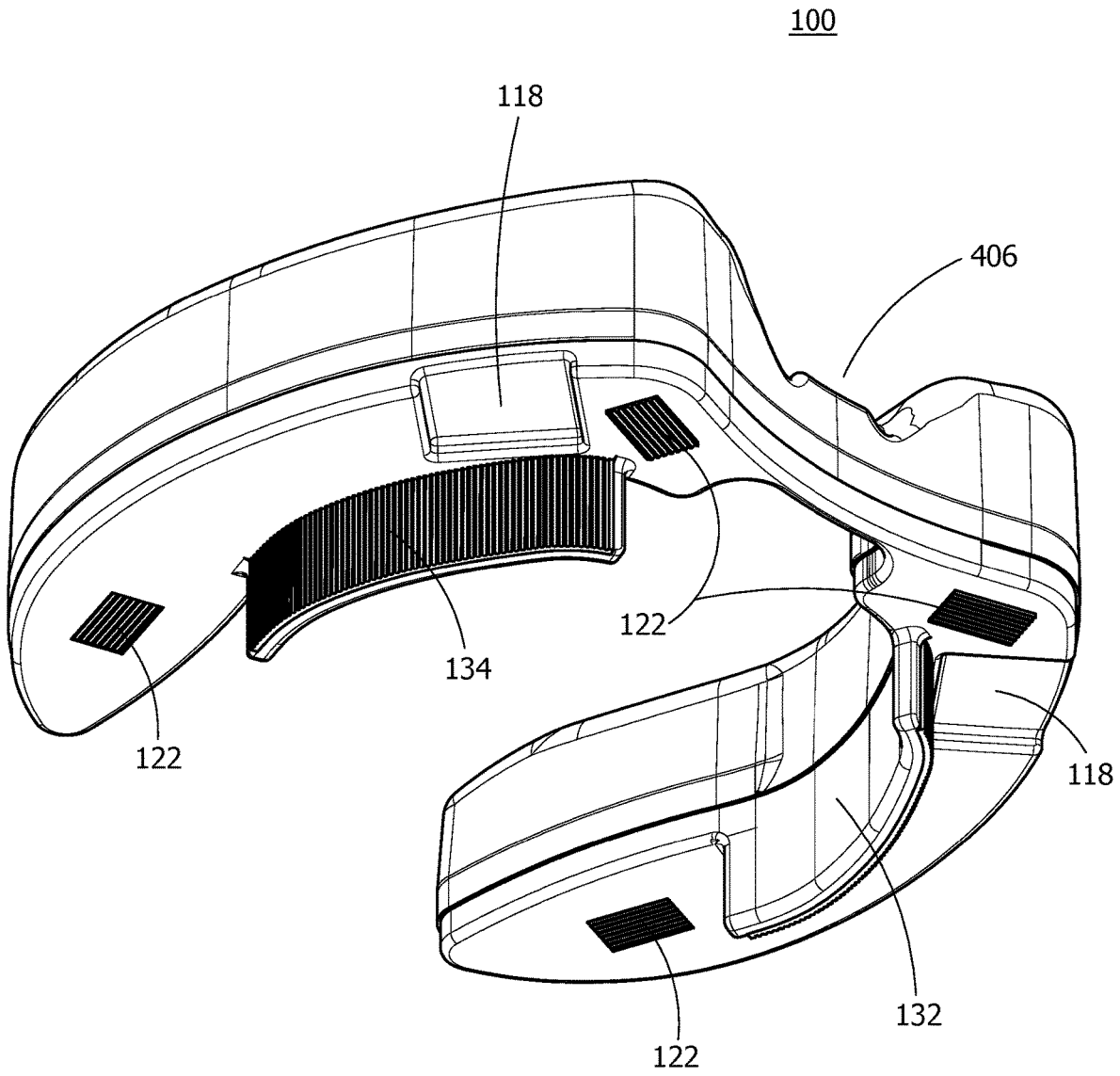
FIG. 2 is a rear bottom perspective view of the adjustable toilet seat riser in FIG. 1.
Figure 3:
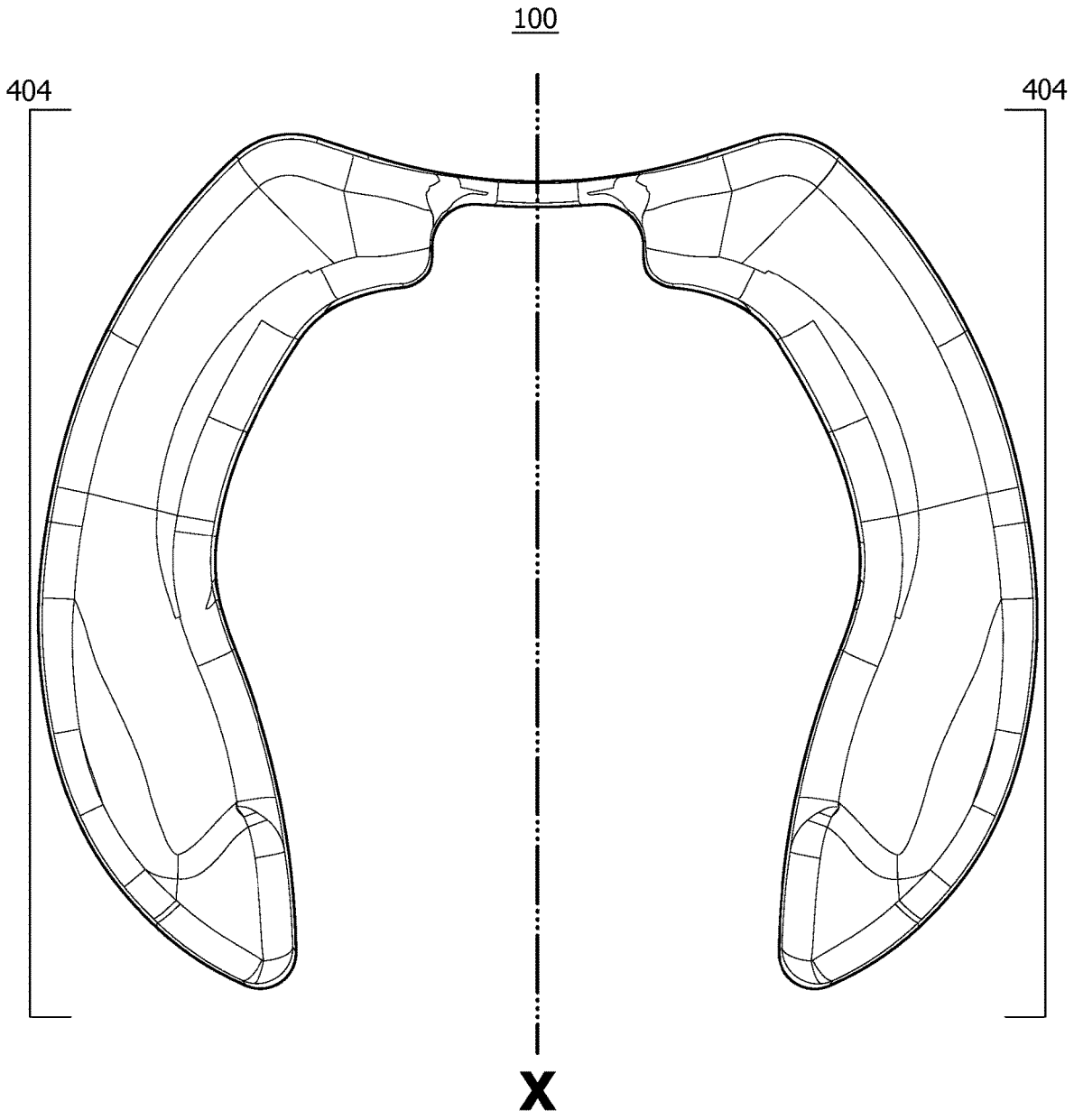
FIG. 3 is a top view of the adjustable toilet seat riser in FIG. 1.
Figure 4:
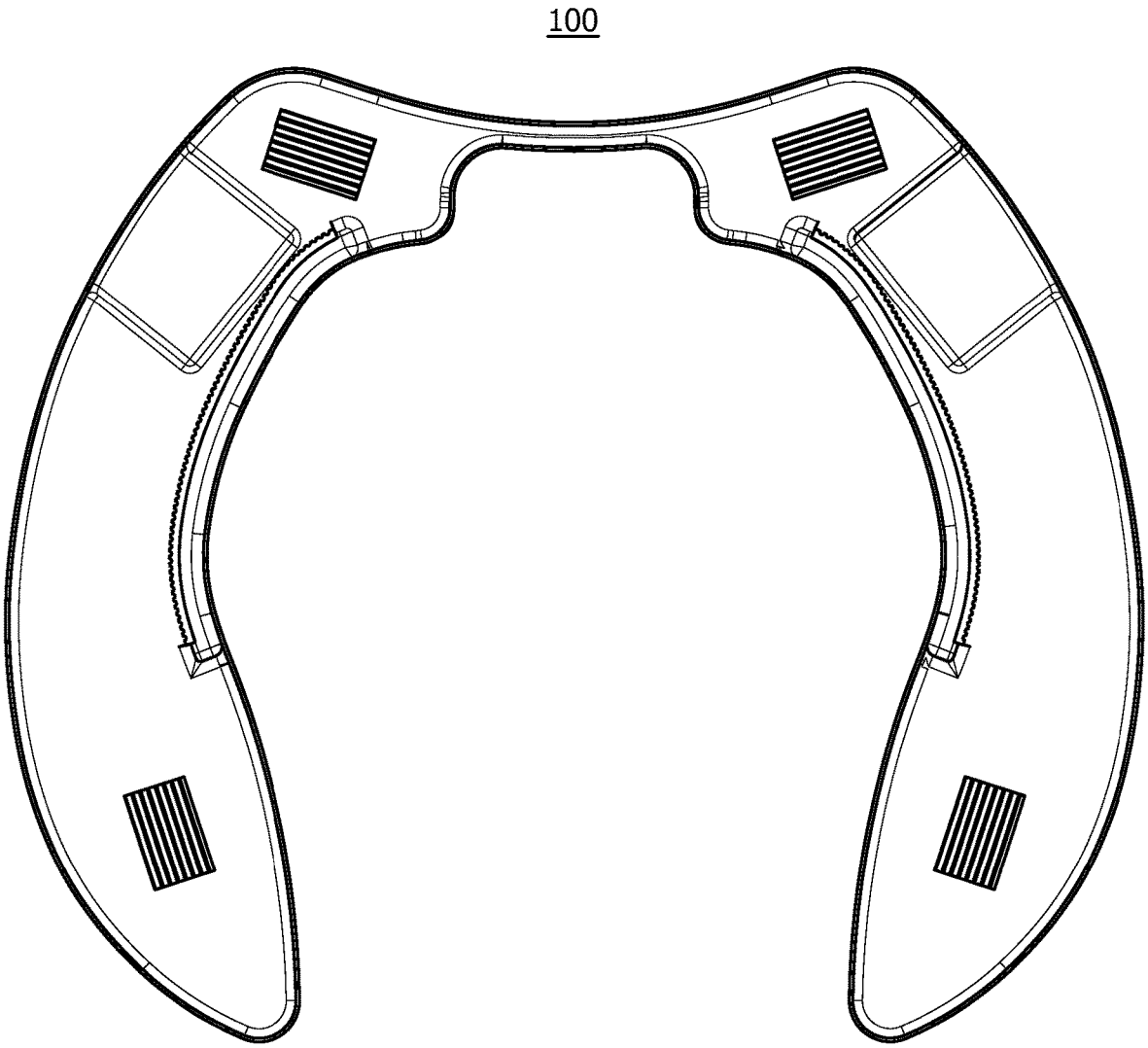
FIG. 4 is a bottom view of the adjustable toilet seat riser in FIG. 1.
Figure 5A:
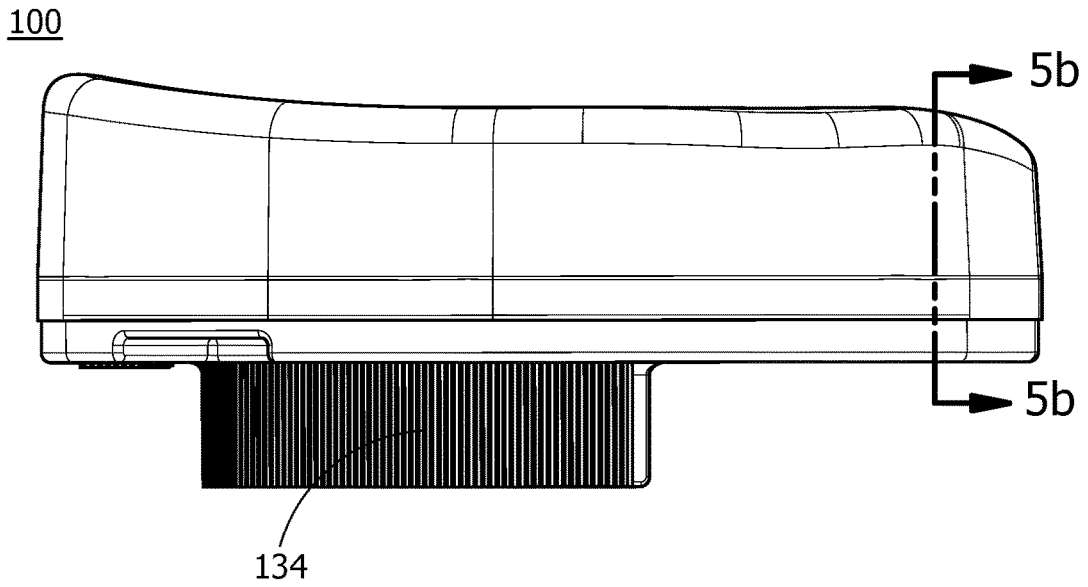
FIG. 5*a* is a left side view of the adjustable toilet seat riser in FIG. 1.
Figure 5B:
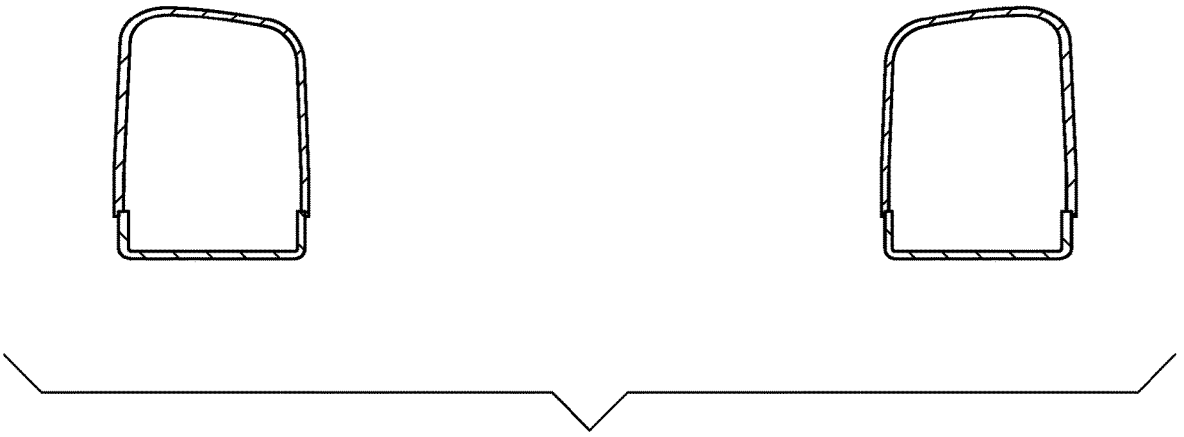
FIG. 5*b* is a front cross-sectional view of the adjustable toilet seat riser as shown in FIG. 5*a*.
Figure 6A:
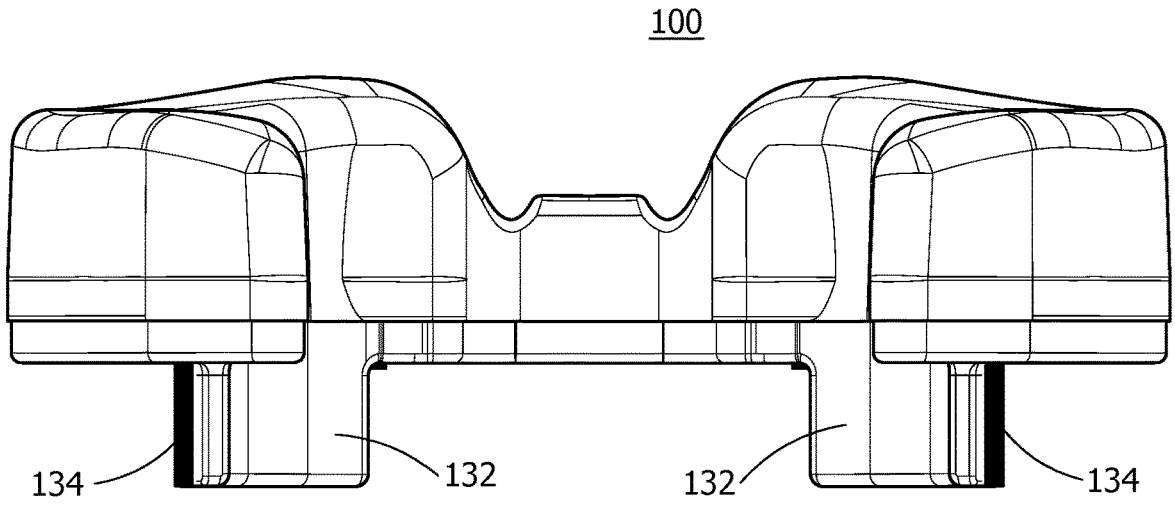
FIG. 6*a* is a front view of the adjustable toilet seat riser in FIG. 1.
Figure 6B:
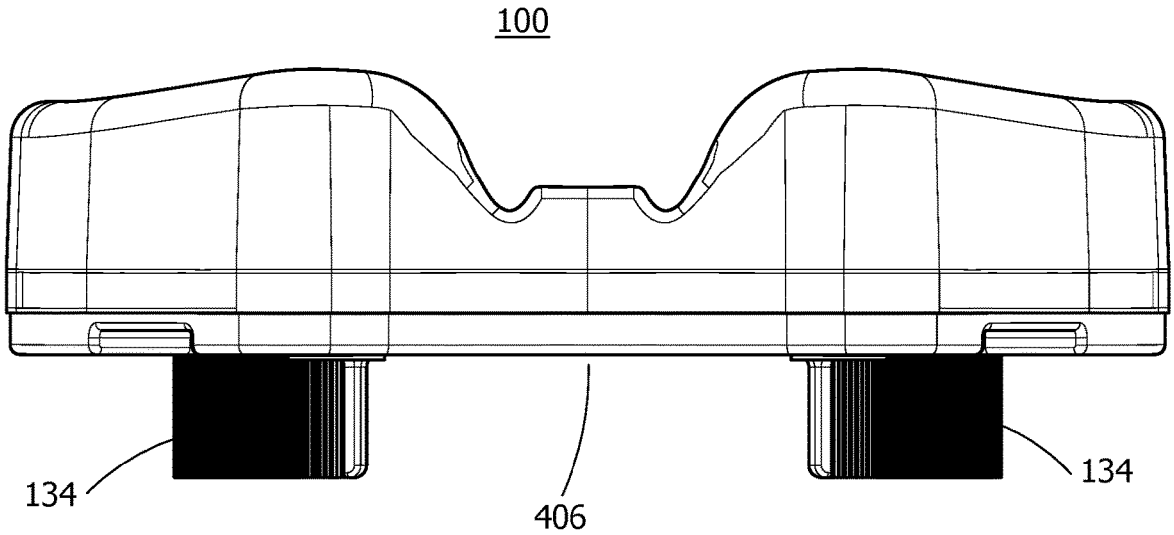
FIG. 6*b* is a back view of the adjustable toilet seat riser in FIG. 1.

When upper seat 102 is joined with lower platform 112, upper seat bridge 104 is aligned with lower platform bridge 114. The joining of upper seat bridge 104 with lower platform bridge 114 forms assembled bridge 406. As shown in FIGS. 1 and 2, upper seat arms 103 are also aligned with lower platform arms 113, which form assembled arms 404.

Prior to joining upper seat 102 to lower platform 112, as shown in FIGS. 8, 9*a*, 9*b*, 10, 11, 12*a*, 12*b*, 15*a*, 15*b*, 16, 17*a*, 17*b*, 18, 19*a*, and 19*b*, spring 108 is positioned to fit within upper seat spring housing 212 and lower platform spring housing 214.

FIGS. 13*a*, 13*b*, 14*a*, and 14*b* display the shape and profile of spring 108. The profile of spring 108 includes spring center 202. Extending from the left side of spring center 202 is spring left inner arm 210 and spring left outer arm 206. Extending from the right side of spring center 202 is spring right inner arm 208 and spring right outer arm 204. The profile of spring 108 resembles a W shape with multiple bends relative to spring center 202. Other embodiments of spring 108 include varying shapes that allow for a similar spring force to allow for elastic compression of assembled arms 404.

Spring left outer arm 206 and spring right outer arm 204 each include spring hook 110. The spring hooks 110 are at an angle relative to spring left outer arm 206 and spring right outer arm 204, respectively. For example, the angle is substantively a right angle. When spring 108 is positioned within upper seat spring housing 212 and lower platform spring housing 214, spring hooks 110 help keep spring 108 in position and minimizes lateral movement of spring 108 within upper seat spring housing 212 and lower platform spring housing 214. Spring 108 is still able to elastically flex within assembled bridge 406 in conjunction with the movement of assembled arms 404 during installation on toilet 302.

Assembled arms 404 includes upper seat arms 103 and lower platform arms 113 when upper seat 102 is secured to lower platform 112. Assembled arms 404 are mirror images of each other, i.e., they are inverted 180 degrees relative to the centerline of the adjustable toilet seat riser 100 passing through the upper seat bridge 104 and lower platform bridge 114. See axis X on FIG. 3. Assembled bridge 406 connects to assembled arms 404. When adjustable toilet seat riser 100 is fully assembled, spring 108 is positioned within upper seat spring housing 212 and lower platform spring housing 214 within assembled bridge 406.

The use of spring 108 within assembled bridge 406 creates a live hinge in the adjustable toilet seat riser 100. A live hinge is defined as the section of the adjustable toilet seat riser 100 that elastically flexes when a user presses assembled arms 404 inward, and which flexes back towards its natural uncompressed state (position) when the force by the user on the assembled arms 404 is removed. The live spring is the ability of the assembled bridge 406 to flex with spring 108, which is inside assembled bridge 406.

Figure 16:
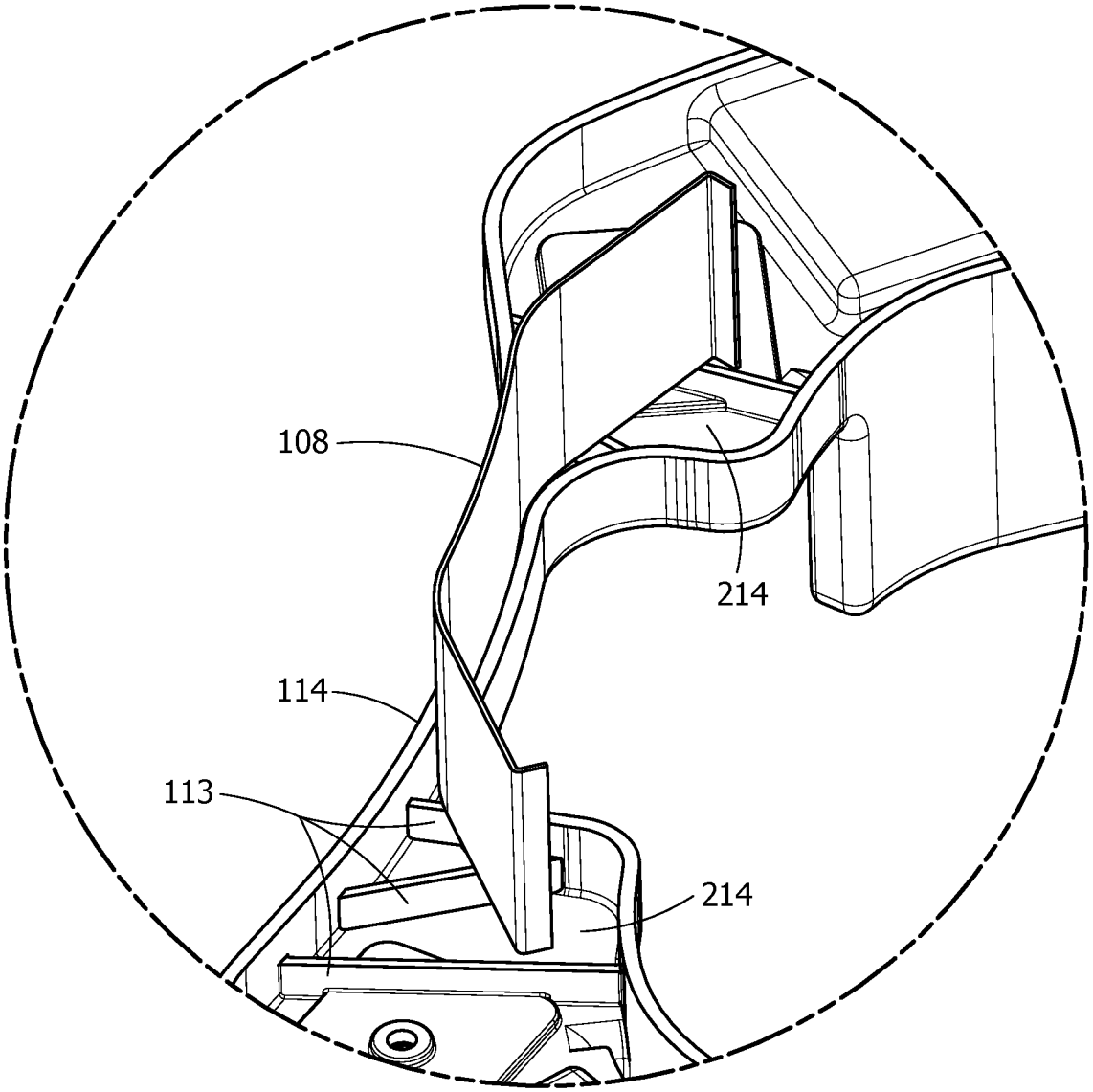
FIG. 16 is a zoomed in section of the lower platform spring housing, spring, and lower platform bridge as shown in FIG. 15*a*.
Figure 17A:
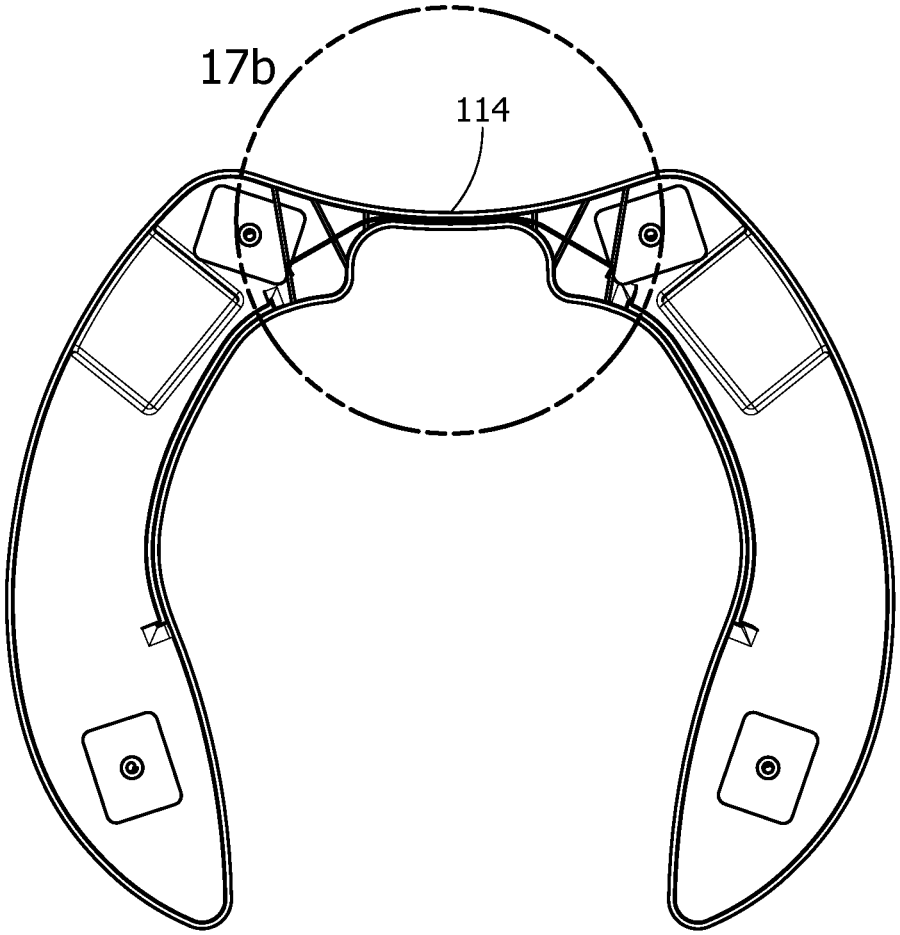
FIG. 17*a* is a bottom view of the lower platform of the adjustable toilet seat riser in FIG. 1 with the spring positioned in the lower platform spring housing.
Figure 17B:
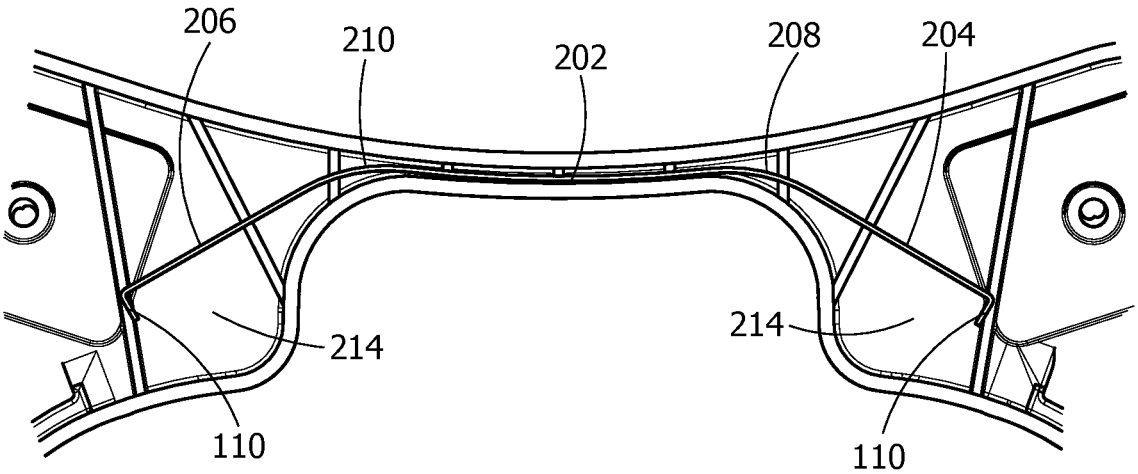
FIG. 17*b* is a zoomed in section of the lower platform bridge with spring positioned in the lower platform spring housing of FIG. 17*a*.
Figure 18:
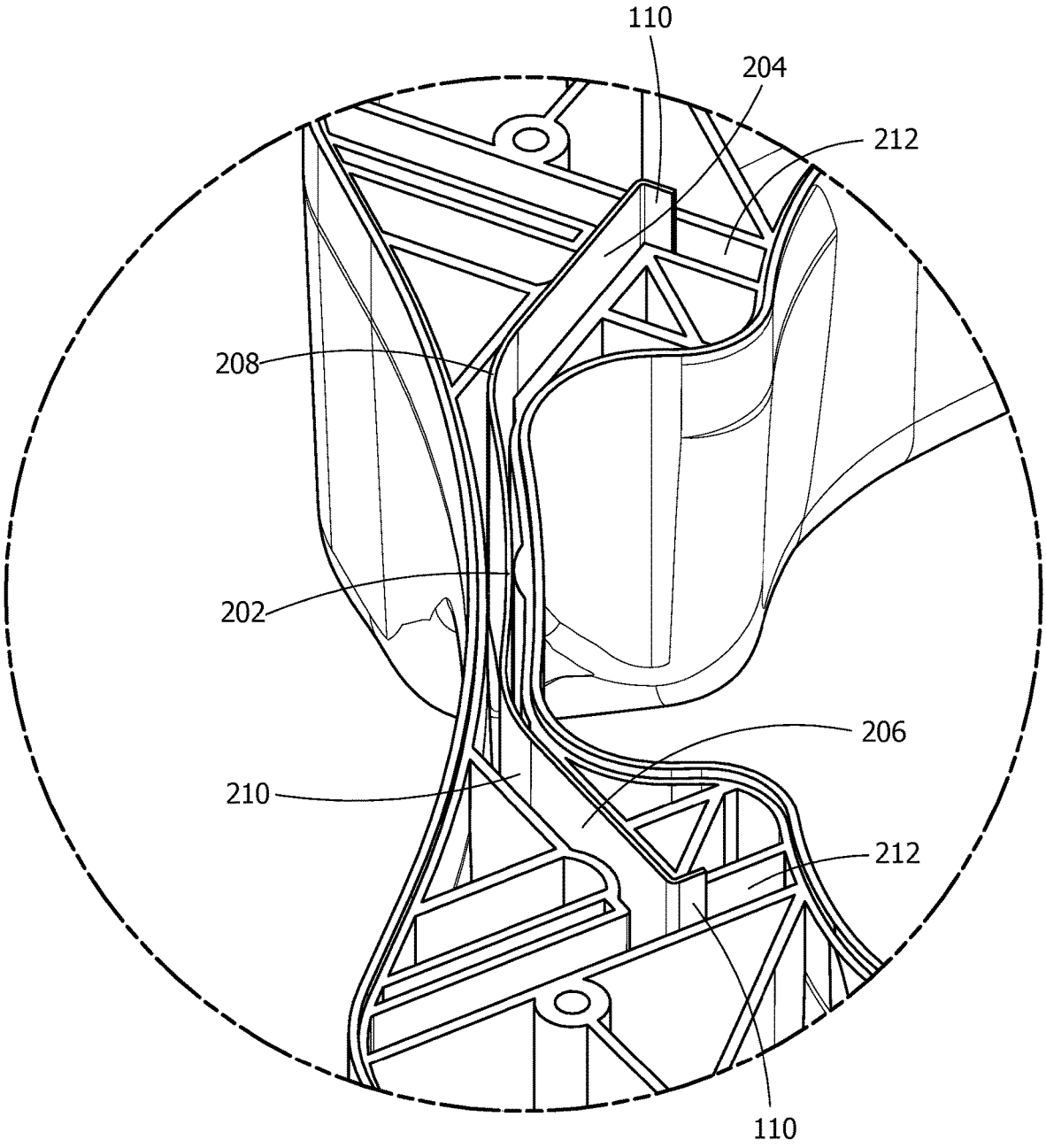
FIG. 18 is a zoomed in section of the upper seat spring housing, spring, and upper seat bridge as shown in FIG. 15*b*.
Figure 19A:
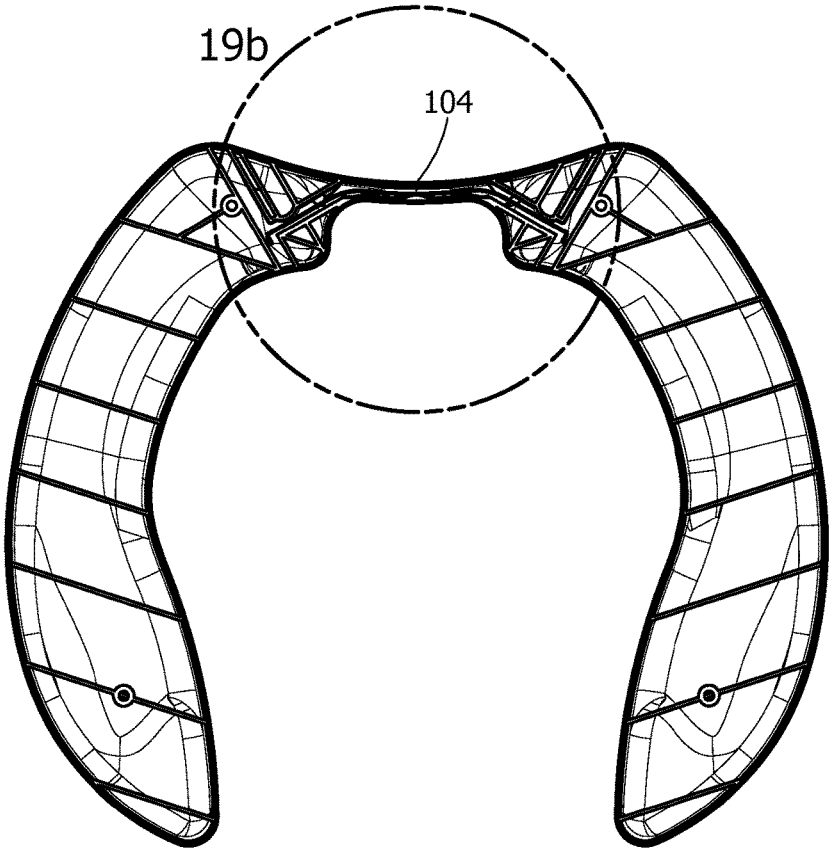
FIG. 19*a* is a bottom view of the upper seat of the adjustable toilet seat riser in FIG. 1 with the spring positioned in the upper seat spring housing.
Figure 19B:
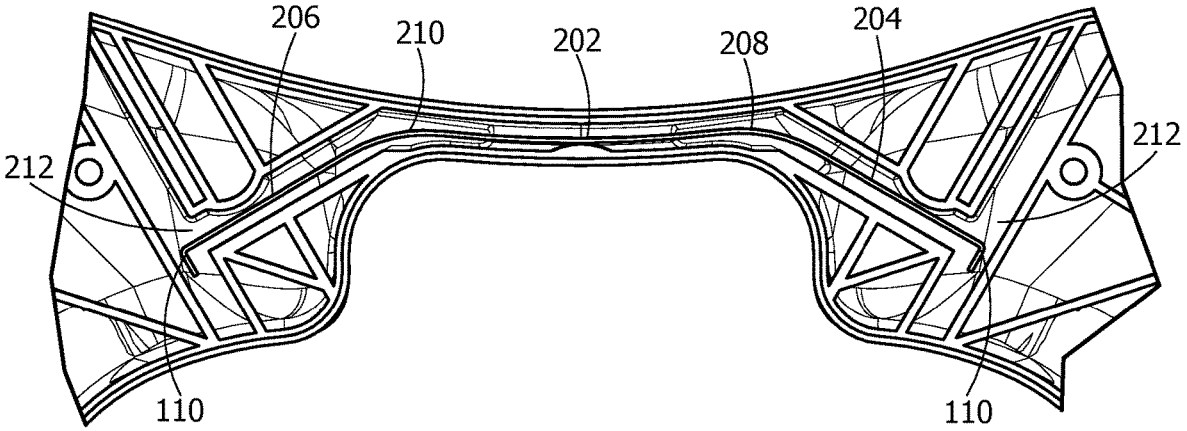
FIG. 19*b* is a zoomed in section of the upper seat bridge with spring positioned in the upper seat spring housing of FIG. 19*a*.

FIGS. 8 and 16 show spring 108 being positioned within the lower platform spring housing 214. The lower platform spring housing 214 includes lower platform baffles 131, which are smaller in height than the overall height of lower platform 104. The smaller height of lower platform baffles 131 allow spring 108 to be positioned within the lower platform spring housing 214. The height of lower platform baffles 131 fill in the vertical space when spring 108 is in position in lower platform spring housing 214 to minimize a loose fit of spring 108 within lower platform spring housing 214. Spring 108 is still designed to compress and relaxing based on the user's movement of assembled arms 404.

Spring 108 is made from manganese steel or similar spring steel. Manganese is used for spring 108 due to its durability and resistance to repeated uses over time. When upper seat 102 is assembled with lower platform 112, spring 108 is fully seated within the upper seat spring housing 212 and lower platform spring housing 214 of the adjustable toilet seat riser 100.

As shown in FIGS. 1, 2, 5*a*, 5*b*, 6*a*, 6*b*, 7, and 10, lower platform 112 also includes two sleeves 132 that extend down from the lower platform arms 113. The two sleeves 132 extend past the bottom surface of lower platform arms 113 (FIG. 8). While two sleeves 132 are depicted in the instant invention, an exemplary embodiment includes a single sleeve 132 that travels along both lower platform arms 113 and lower platform bridge 114 (and possibly lower platform bridge). Sleeve gripping pads 134 are connected to the outside of sleeves 132. Sleeves 132 are smaller in width compared to the width of lower platform arms 113.

Figure 10:
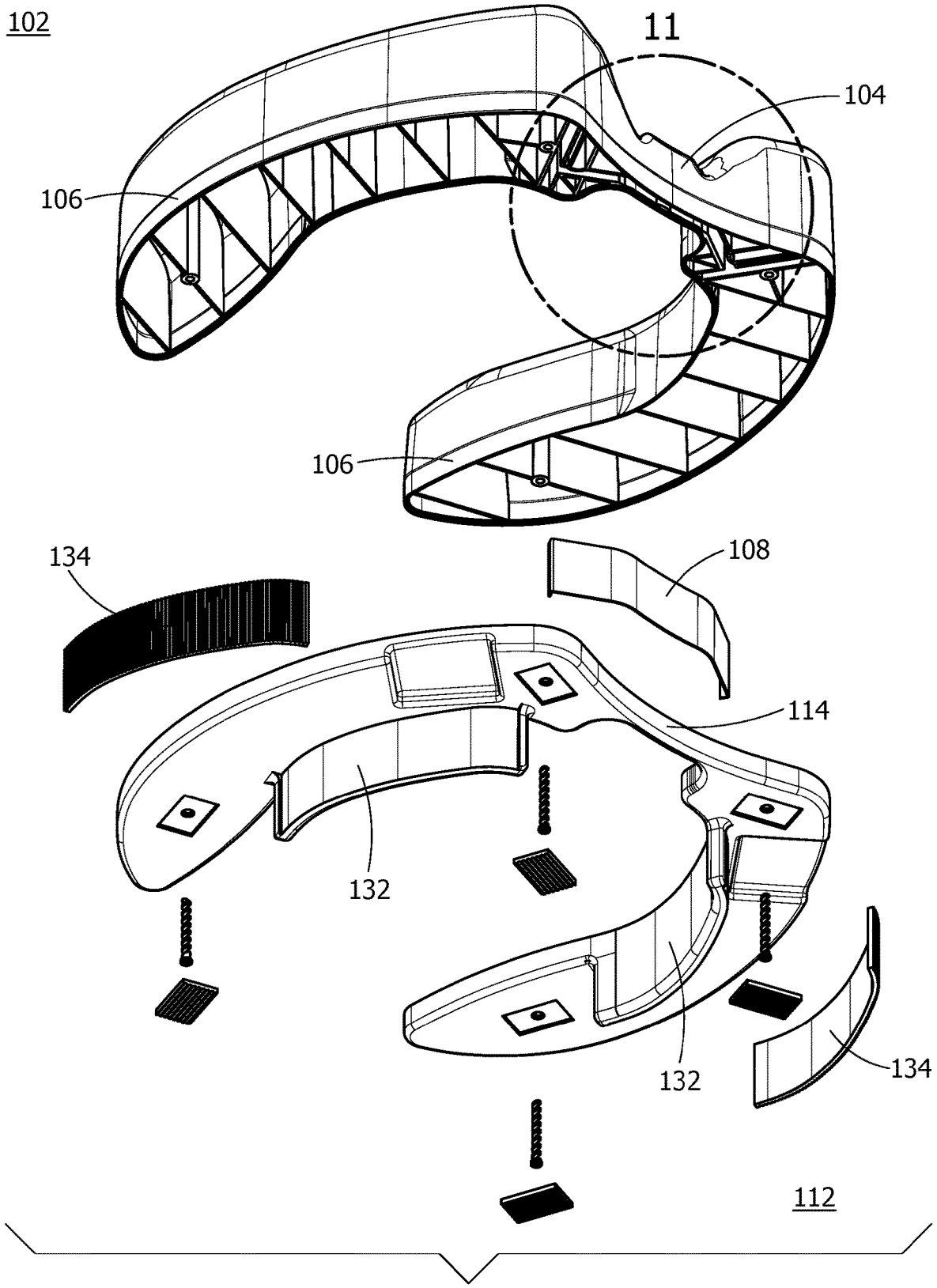
FIG. 10 is a rear bottom perspective exploded view of the adjustable toilet seat riser in FIG. 1.
Figure 11:
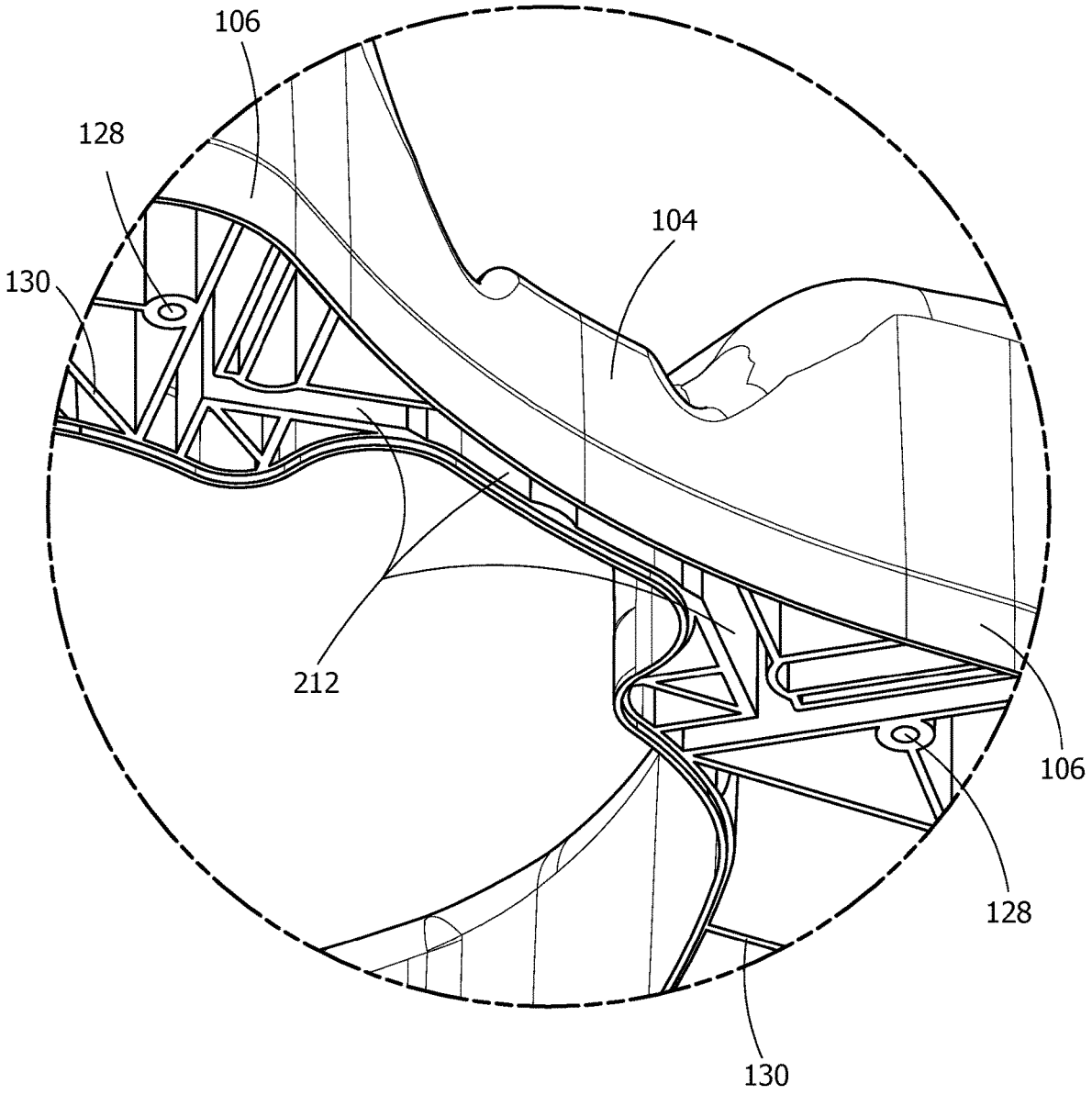
FIG. 11 is a zoomed in section of the upper seat spring housing of the upper seat shown in FIG. 10.
Figure 12A:
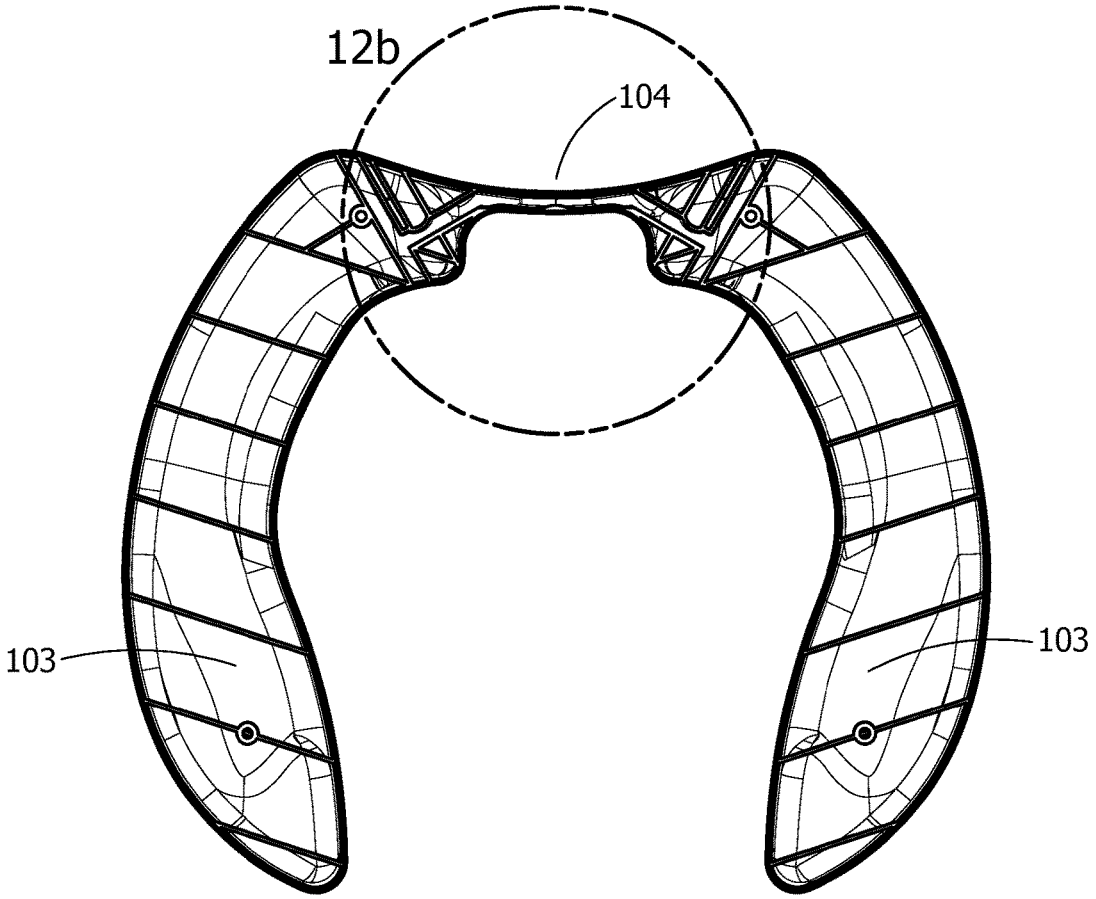
FIG. 12*a* is a bottom view of the upper seat of the adjustable toilet seat riser in FIG. 1 without a spring in the upper seat spring housing.
Figure 12B:
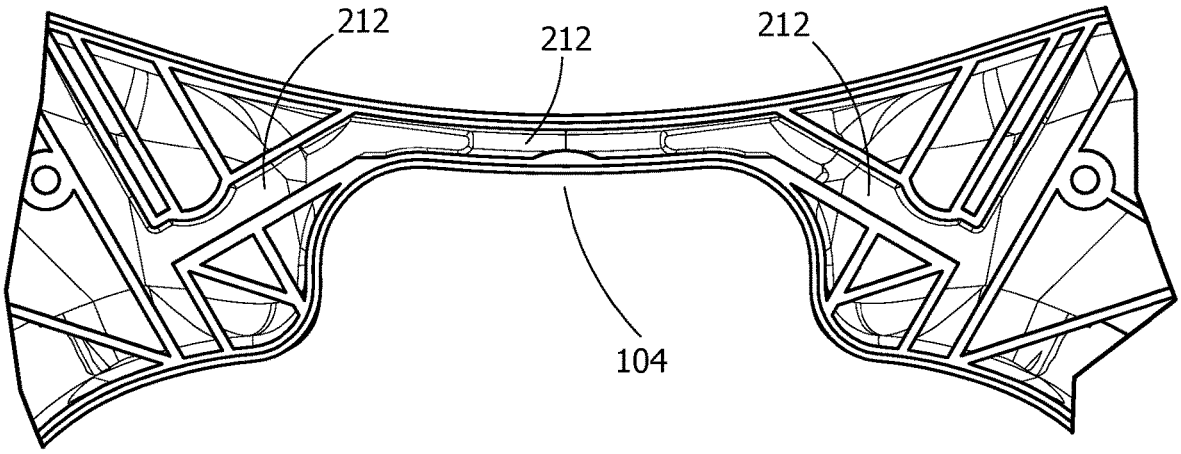
FIG. 12*b* is a zoomed in section of the upper seat spring housing of the upper seat shown in FIG. 12*a*.
Figure 13A:
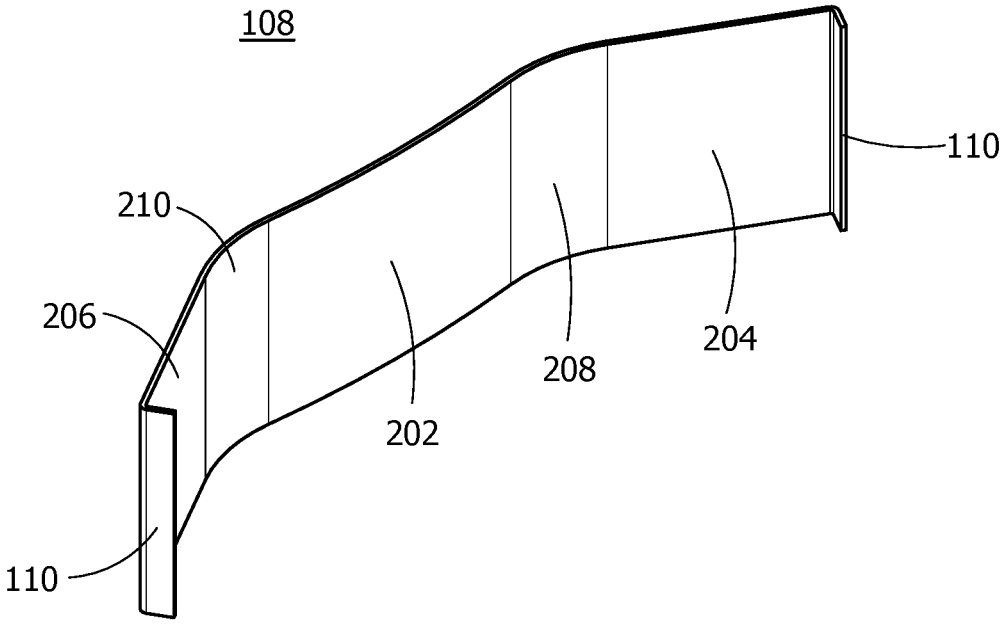
FIG. 13*a* is a top left front perspective view of the internal spring of the adjustable toilet seat riser in FIG. 1.
Figure 13B:
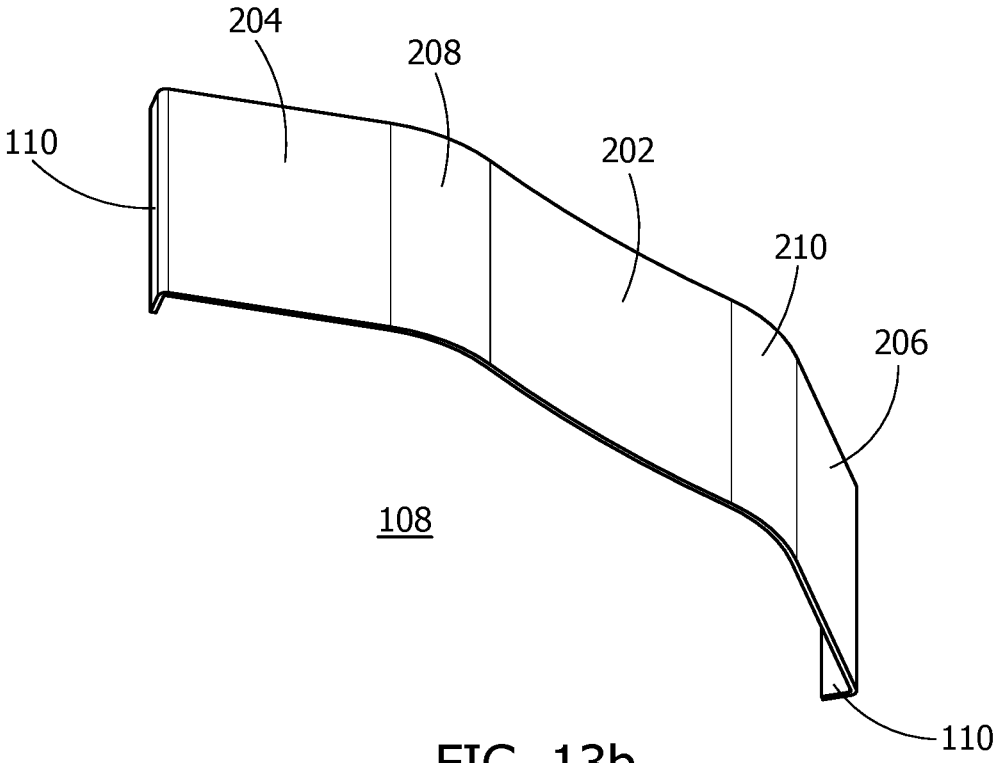
FIG. 13*b* is a bottom right rear perspective view of the internal spring of the adjustable toilet seat riser in FIG. 1.
Figure 14A:
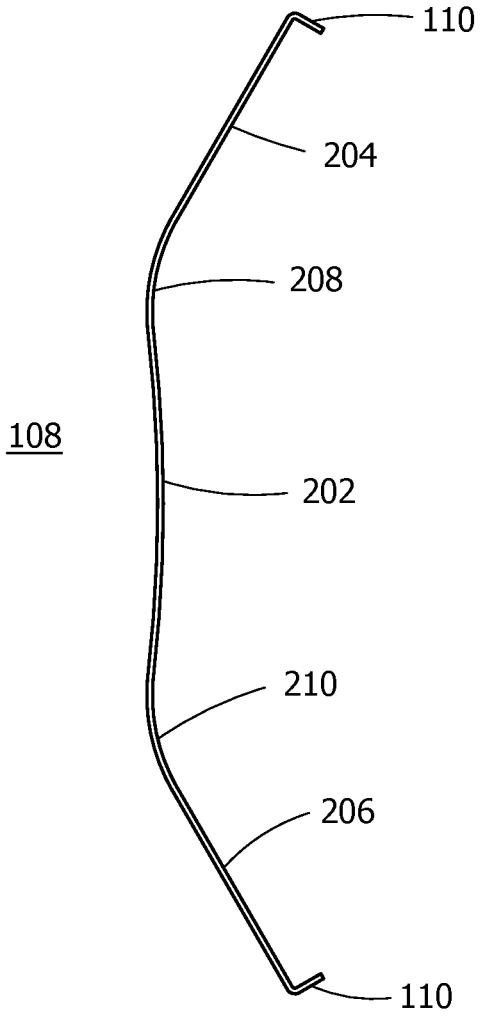
FIG. 14*a* is a top view of the internal spring of the adjustable toilet seat riser in FIG. 1.
Figure 14B:
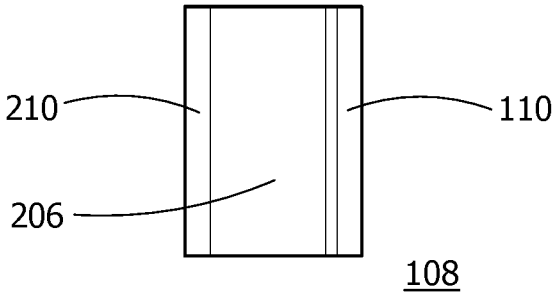
FIG. 14*b* is a side view of the internal spring of the adjustable toilet seat riser in FIG. 1.

To secure upper seat 102 to lower platform 112, upper seat connection surface 106 is aligned to lower platform connection surface 116. Once paired, four fasteners 124 are inserted into the bottom of lower platform 112 and secured to upper seat 102. As shown in FIGS. 7 and 10, four fasteners 124 are used. In exemplary embodiments, more or less than four fasteners 124 are used to secure upper seats 102 to lower platform 112. In another exemplary embodiment, upper seat 102 and lower platform 112 are joined using a welding or heating process, or other permanent securing method. A permanent joining of upper seat 102 to lower platform 112 may negate the need for upper seat connection surface 106 being aligned to lower platform connection surface 116 as upper seat 102 and lower platform 112 can be aligned using fixtures prior to being permanently joined. Upper seat 102 being joined to lower platform 112 can be removably connected, as shown, or permanently connected to each other.

Fasteners 124 are inserted through fastener holes 126 within notches 120 of lower platform 112. Fasteners 124 pass through lower platform 112 and are secured into fasteners inserts 128 of upper seat 102. Fastener inserts 128 are positioned in some of upper seat baffles 130. Upper seat baffles 130 are used to strengthen upper seat 102 to provide stability to the upper seat 102 structure. The placement, spacing, and number of upper seat baffles 130 vary based on the size of the adjustable toilet sear riser 100 and how many fasteners 124 are used to secure upper seat 102 to lower platform 112. Lower platform 112 also include two protrusions 118 that help stabilize lower platform 112. The placement, spacing, and number of protrusions 118 vary based on the size of the adjustable toilet seat riser 100.

Figure 15A:
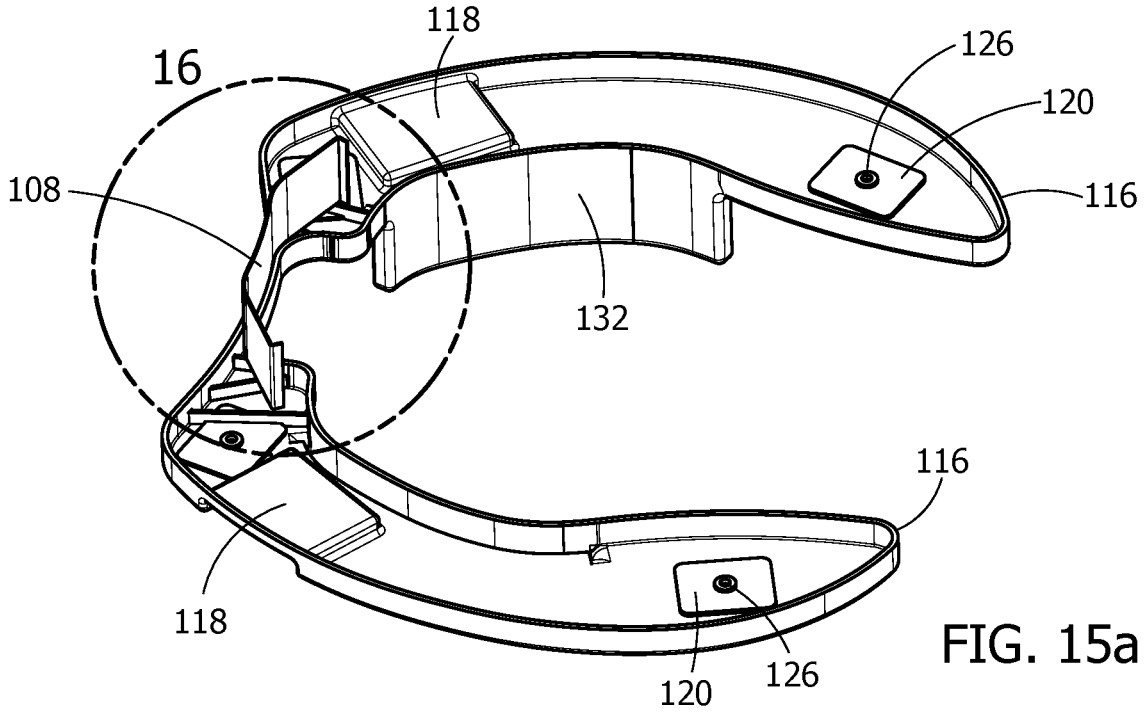
FIG. 15*a* is a top side perspective view of the lower platform of the adjustable toilet seat riser in FIG. 1.
Figure 15B:
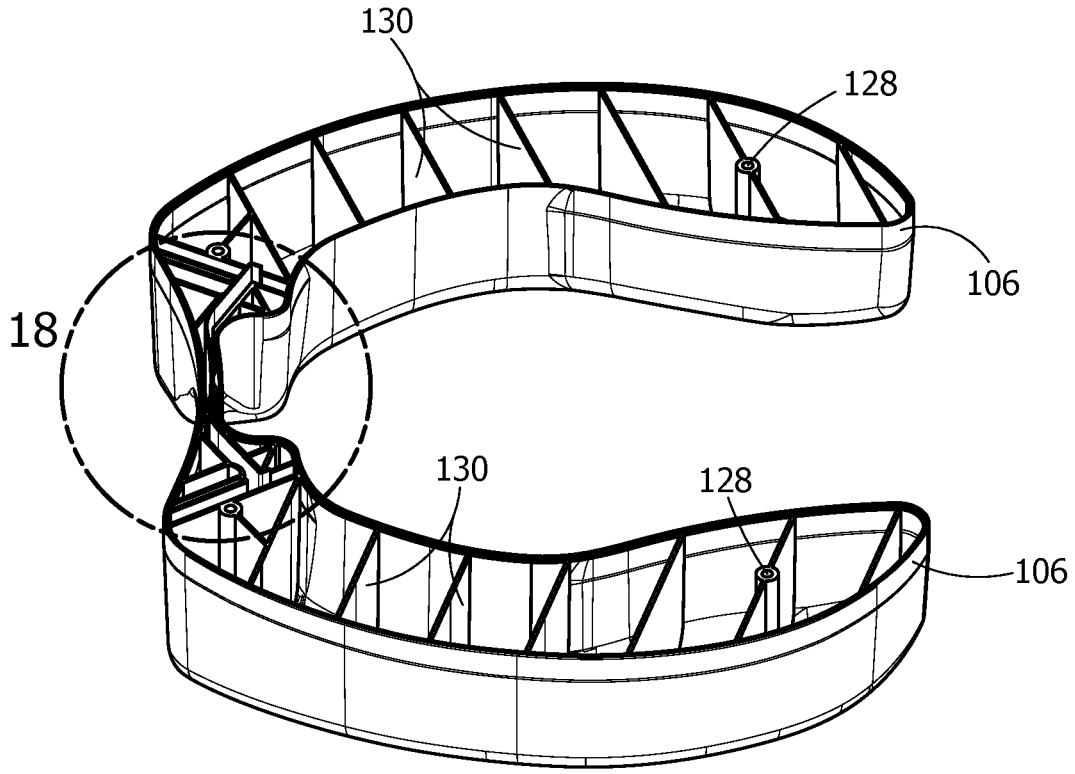
FIG. 15*b* is a bottom side perspective view of the upper seat of the lower platform of the adjustable toilet seat riser in FIG. 1, showing the internal upper seat baffles.

As shown in FIGS. 7 and 15*a*, fasteners 124 are inserted into fastener holes 126 at four specific positions in the bottom of lower platform 112. Fastener holes 126 are located at four notch 120 positions in the bottom of lower platform 112. There are two fastener holes 126 in each lower platform arm 113.

Notches 120 are indented in the bottom of lower platform 112, as shown in FIGS. 7, 8, and 15*a*. The indentations of notches 120 allow for spacing of the head of fasteners 124 (e.g., screw head). In addition, the indentations of notches 120 provide space for notch gripping pads 122. The notch gripping pads 122 provide two main purposes. First, to cover the heads of fasteners 124 and avoid scratching toilet 302. Second, to provide a friction surface to minimize or prevent the adjustable toilet seat riser 100 from moving relative to toilet 302 when installed on toilet 302.

When upper seat 102 is secured to lower platform 112, spring 108 is positioned within upper seat spring housing 212 and lower platform spring housing 214 (which is within upper seat bridge 104 and lower platform bridge 114). When upper seat 102 is assembled to lower platform 112, assembled bridge 406 includes upper seat bridge 104 and lower platform bridge 114.

Figure 20:
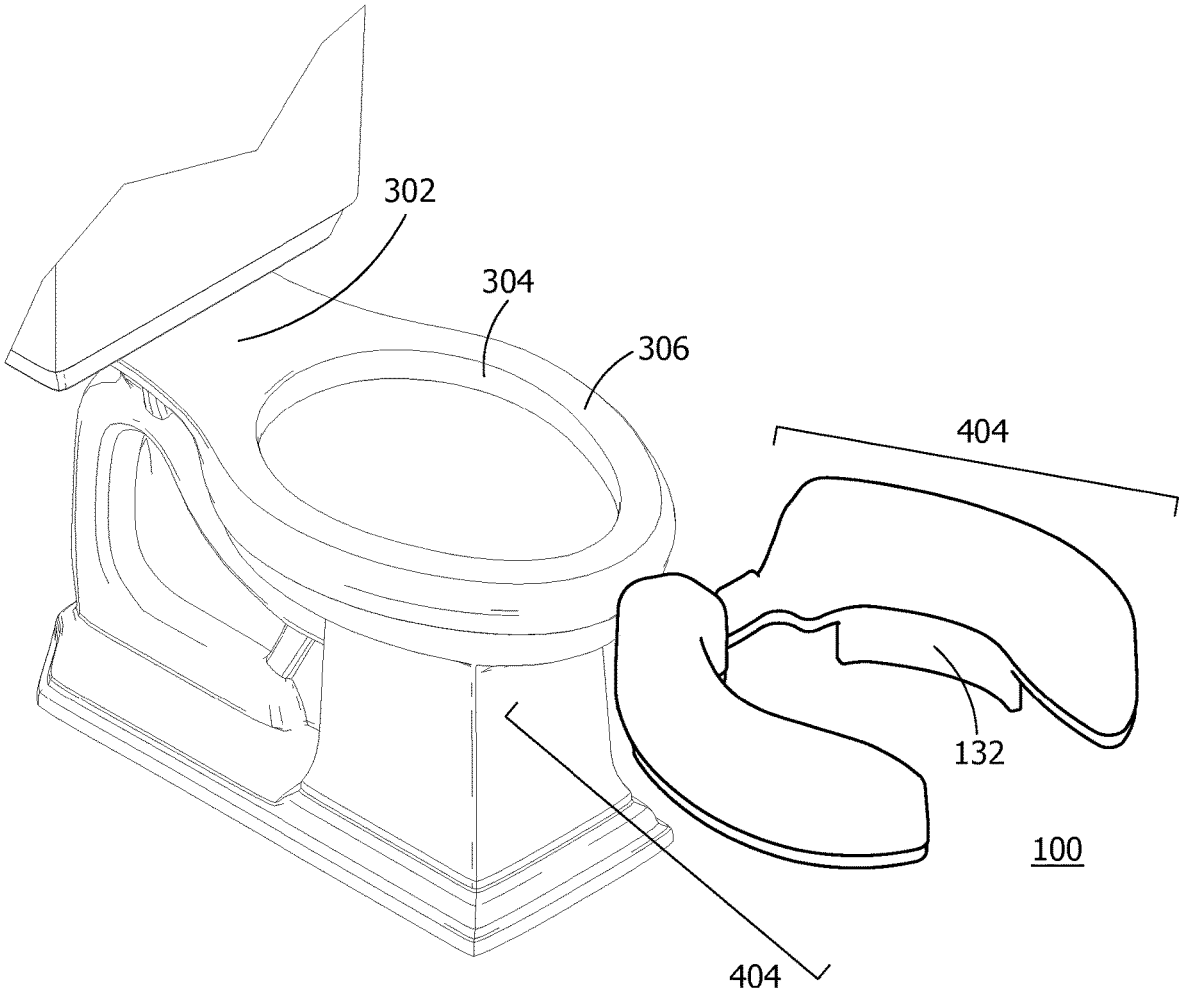
FIG. 20 is a front top perspective view of the adjustable toilet seat riser in FIG. 1 in front of a toilet in an uncompressed position.

FIG. 20 shows adjustable toilet seat riser 100 in front of a toilet 302 with inner rim 304. As shown in FIG. 20, assembled bridge 406 of adjustable toilet seat riser 100 is in a relaxed, uncompressed position.

Figure 21:
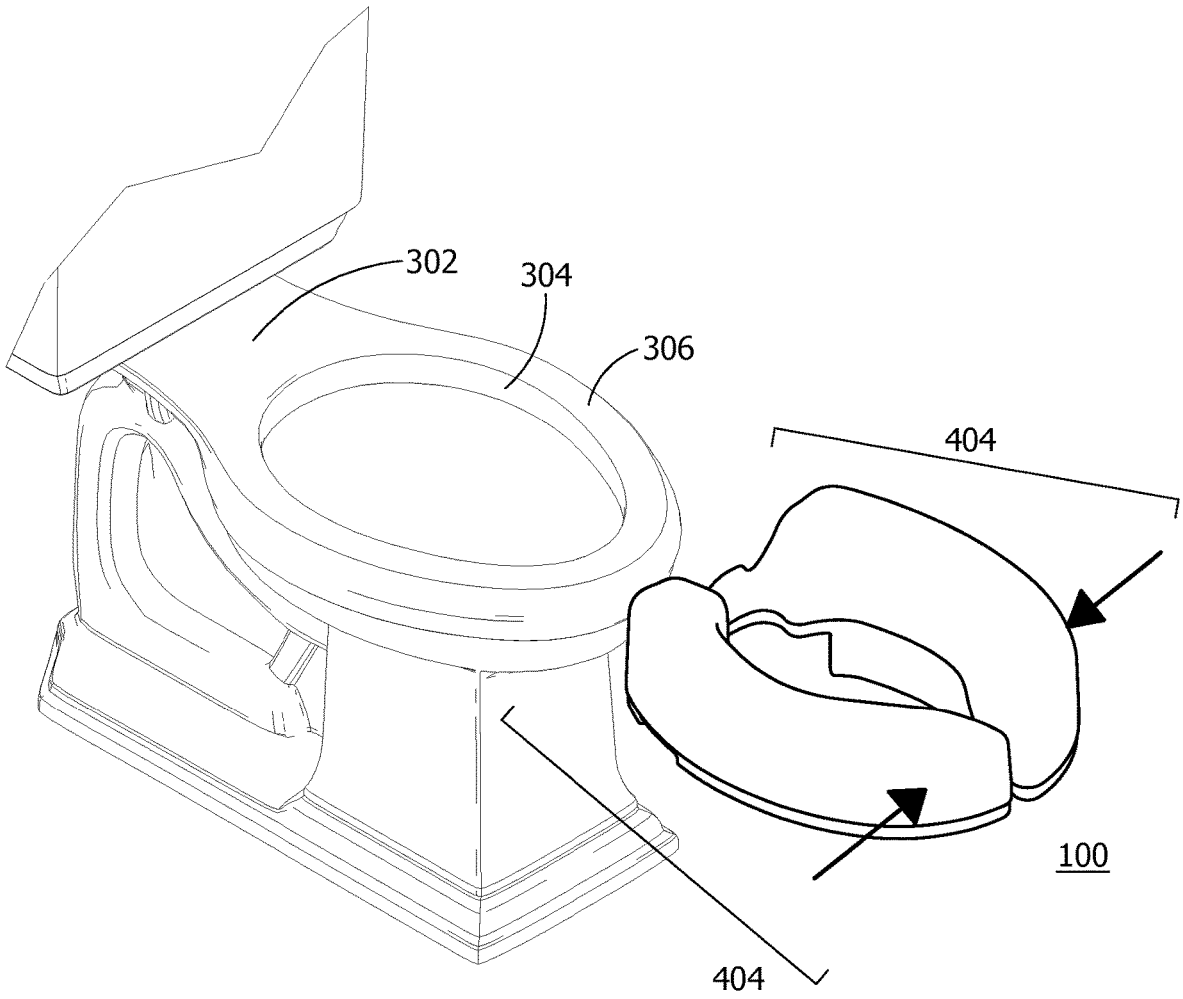
FIG. 21 is a front top perspective view of the adjustable toilet seat riser in FIG. 1 in front of a toilet, showing the ends of the adjustable toilet seat riser (assembled arms) being compressed inward.

In FIG. 21, a user presses inward on the outside of both assembled arms 404 while the adjustable toilet seat riser 100 is not engaged with toilet 302. The inward compression of assembled arms 404, towards each other, elastically flexes spring 108 located within assembled bridge 406, along with elastically flexing assembled bridge 406 itself (which includes upper seat bridge 104 and lower platform bridge 114).

Figure 22:
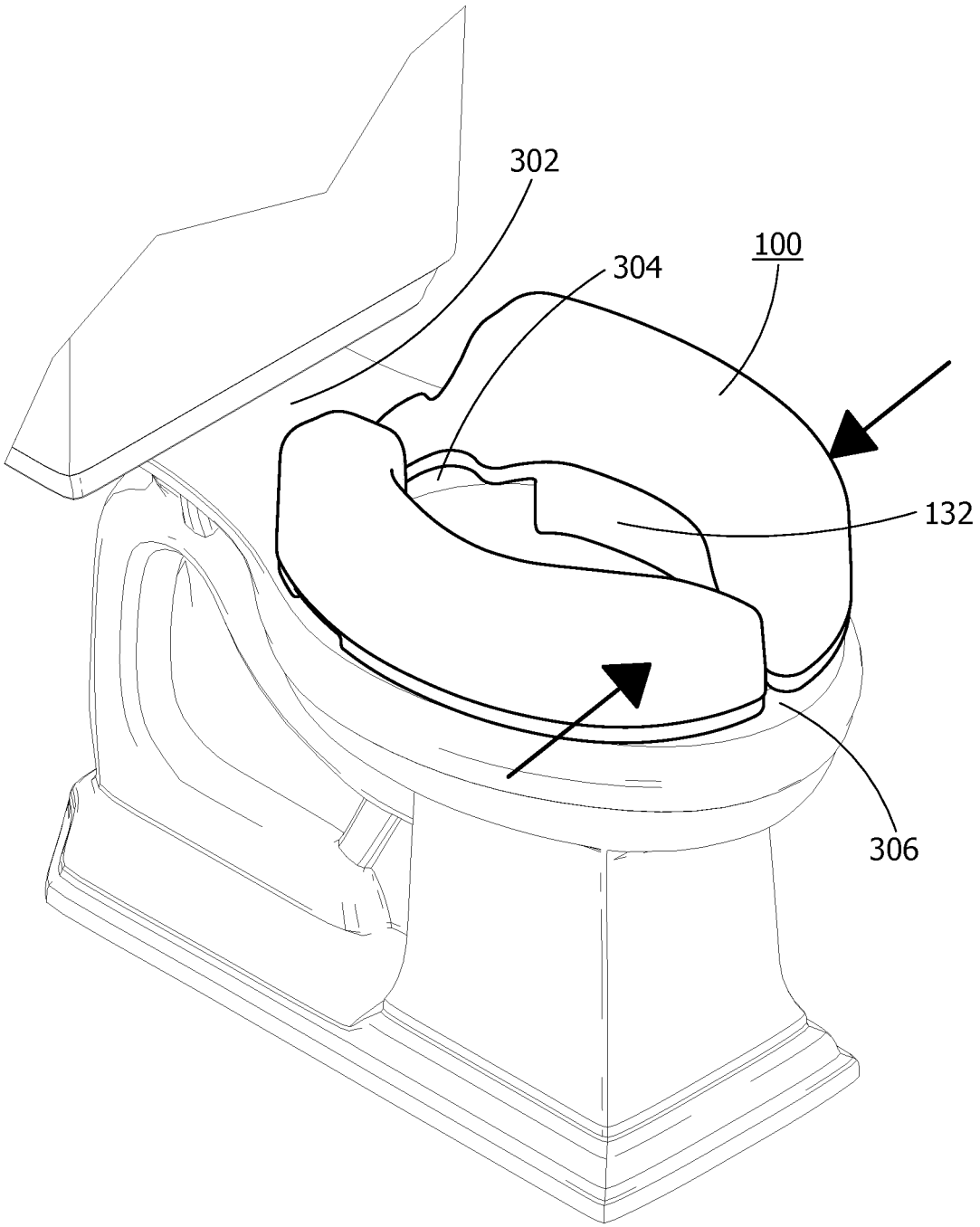
FIG. 22 is a front top perspective view of adjustable toilet seat riser in FIG. 1 on top of a toilet, showing the ends of the adjustable toilet seat riser (assembled arms) being compressed inward.

In FIG. 22, the user positions adjustable toilet seat riser 100, in a compressed state from FIG. 21, onto toilet 302. The compressed state of adjustable toilet seat riser 100 positions the two sleeves 132 (one sleeve 1332 on each arm) to fit within the inner rim 304 of toilet 302. When the user positions the compressed adjustable toilet seat riser 100 on toilet 302, the two sleeves 132 are positioned within inner rim 304 and the bottom of lower platform 112 is positioned on the top rim 306 of toilet 302.

Figure 23:
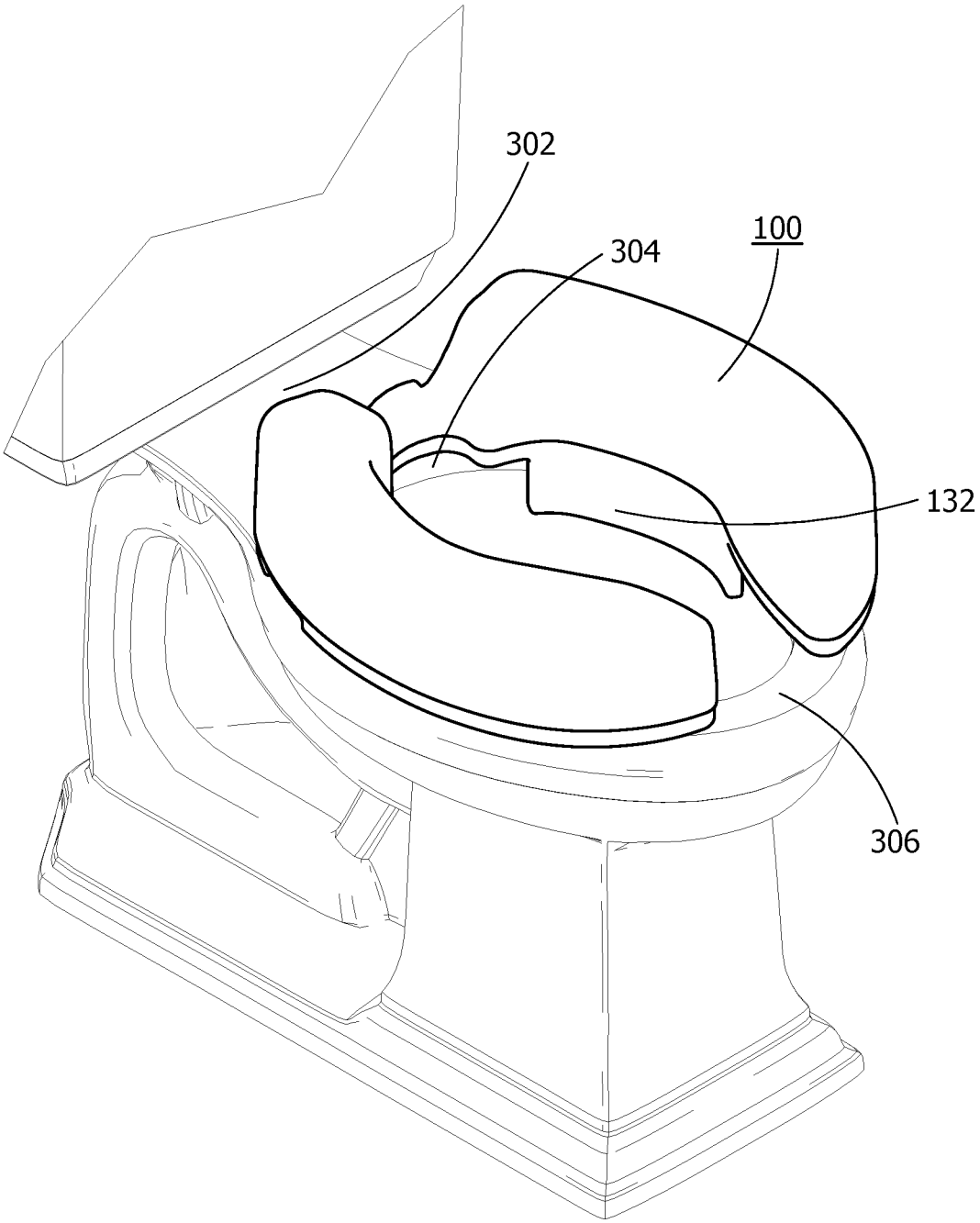
FIG. 23 is a front top perspective view of the adjustable toilet seat riser in FIG. 1 on top of a toilet, showing the ends of the adjustable toilet seat riser (assembled arms) released with the sleeves pressing the toilet rim.

Sleeves 132 include sleeve gripping pads 134 on the outer surface of the sleeves 132, i.e. the side of sleeve 132 that comes into contact with inner rim 304. See FIGS. 2, 5*a*, 5*b*, 6*a*, 6*b*, 7, 10, and 25. Next, as shown in FIG. 23, the user removes her inward force on assembled arms 404. This causes the assembled arms 404 to expand outward due to the spring force of spring 108 trying to return to its natural state (i.e., FIG. 20). As the user removes the force on assembled arms 404, sleeve gripping pads 134 come in contact with inner rim 304. Spring 108 is unable to return to its natural, fully relaxed state (i.e., FIG. 20). Instead, sleeves 132 continue to exert force onto inner rim 304 to keep adjustable toilet seat riser 100 firmly secured (i.e., positioned) on toilet 302.

When fully positioned, the bottom of notch gripping pads 122 are in contact with top rim 306. Sleeve gripping pads 134 are also in contact with inner rim 304. The use of notch gripping pads 122 and sleeve gripping pads 134 help stabilize (and secure) adjustable toilet seat riser 100 to toilet 302. Notch gripping pads 122 and sleeve gripping pads 134 work to prevent movement of adjustable toilet seat riser 100 relative to toilet 302 due to the frictional contact between notch gripping pads 122 and top rim 306, and the frictional contact between sleeve gripping pads 134 and inner rim 304. Notch gripping pads 122 are preferably made from a rubber material or any other material that will create a frictional contact with toilet 302. In an exemplary embodiment, notch gripping pads 122 include raised bands, ripples, or spacers.

While notch gripping pads 122 and sleeve gripping pads 134 are used in the instant invention, an exemplary embodiment of adjustable toilet seat riser 100 does not use notch gripping pads 122 and sleeve gripping pads 134. In another exemplary embodiment, the material of adjustable toilet seat riser 100 creates enough frictional contact to prevent movement of adjustable toilet seat riser 100 relative to toilet 302.

While some movement of adjustable toilet seat riser 100 relative to toilet 302 is expected, the user should be able to sit on adjustable toilet seat riser 100 without risk of falling off of toilet 302. The use of notch gripping pads 122 and sleeve gripping pads 134 help prevent slippage of adjustable toilet seat riser 100 relative to toilet 302, which stabilizes the user while sitting on adjustable toilet seat riser 100.

Figure 24:
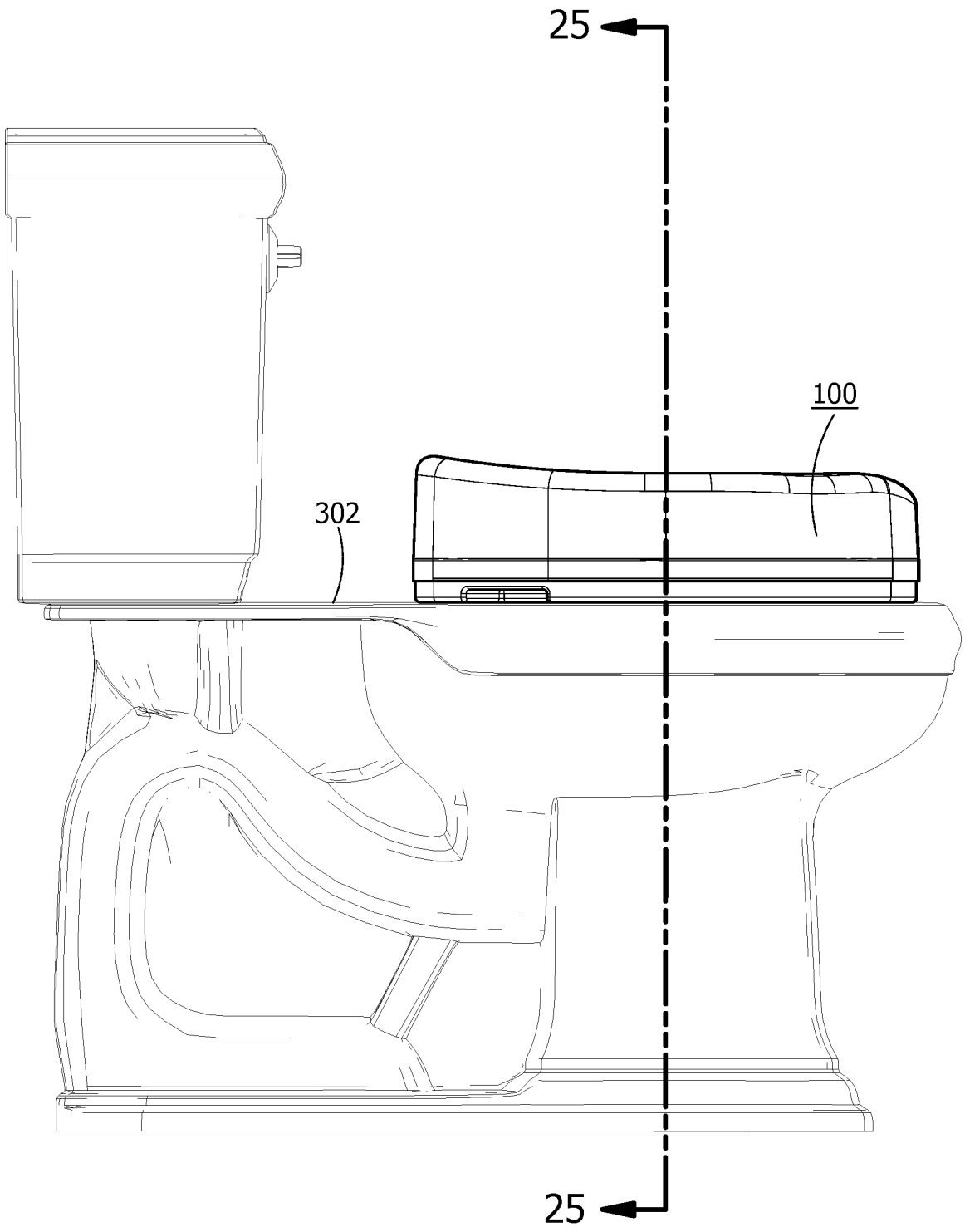
FIG. 24 is a side view of the adjustable toilet seat riser in FIG. 1 on top of a toilet, showing the ends of the adjustable toilet seat riser released with the sleeves pressing the toilet rim.
Figure 25:
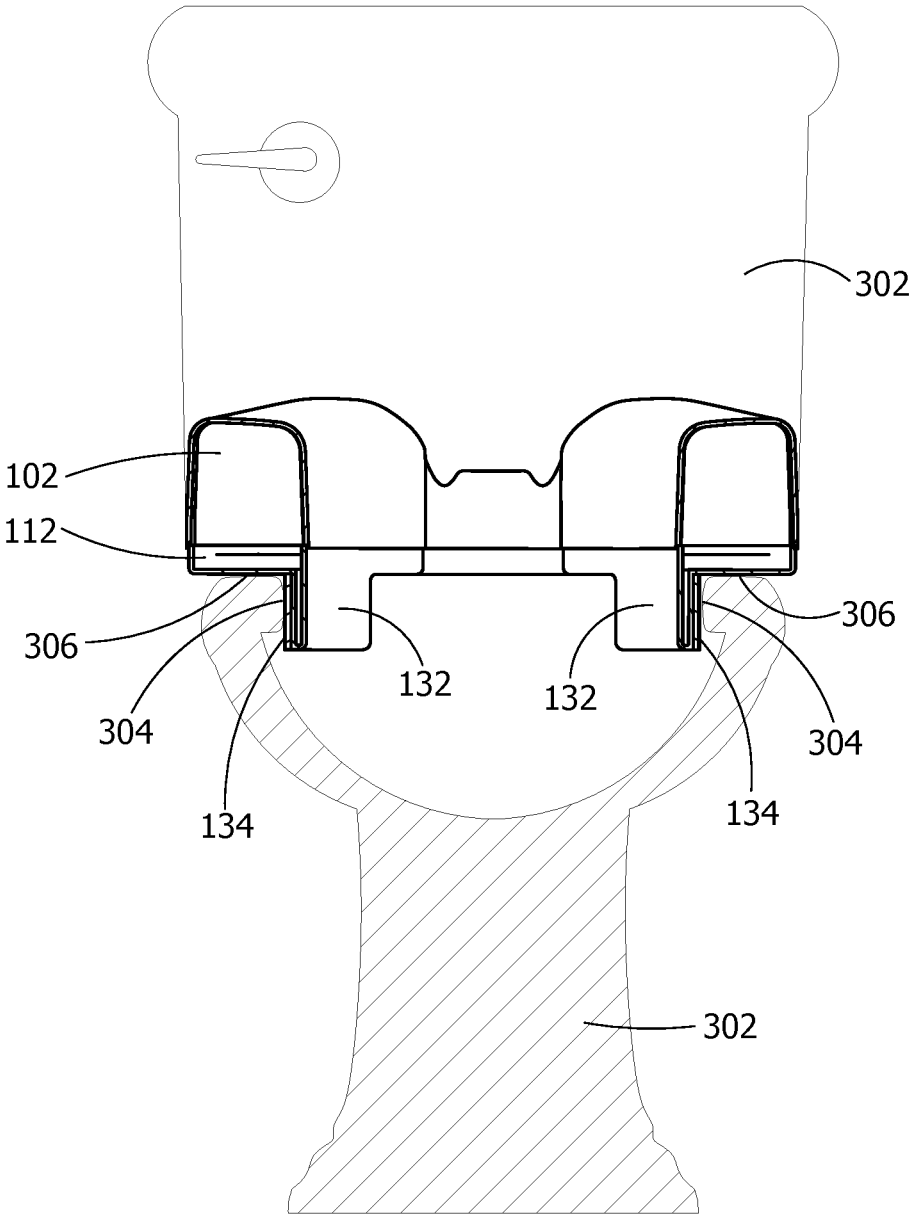
FIG. 25 is a front cross-sectional view of the adjustable toilet seat riser in FIG. 1 on top of a toilet, showing the ends of the adjustable toilet seat riser released with the sleeves pressing the toilet rim.

FIGS. 24 and 25 show adjustable toilet seat riser 100 positioned onto toilet 302. FIG. 24 shows a side view of the adjustable toilet seat riser 100 installed on toilet 302. As shown, the notch gripping pads 122 (or the bottom surface of lower platform 112 if the notch gripping pads 122 are not present) contact the top rim 306. In addition, sleeve gripping pads 134 (or the outer surface of sleeves 132 if sleeve gripping pads 134 are not present) contact the inner rim 304. FIG. 25 shows a cross section view of the toilet 302 with adjustable toilet seat riser 100 installed on toilet 302. FIG. 25 shows the contact points of adjustable toilet seat riser 100 on toilet 302, including the positioning of adjustable toilet seat riser 100 relative to the inner rim 304 and top rim 306.

The assembled bridge 406 portion of the adjustable toilet seat riser 100 is elastic, which allows assembled arms 404 to flex relative to assembled bridge 406. The shape of spring 108 and assembled bridge 406 is designed to permit assembled arms 404 to be pressed inward, closer to each other, for placement on a toilet 302. Particularly to permit sleeves 132 to fit within inner rim 304.

The flexible nature of assembled bridge 406, which includes spring 108, allows assembled arms 404 to retract back to their natural position. When engaged on adjustable toilet seat riser 100, assembled arms 404 are unable to fully return to their natural, relaxed state, due to sleeves 132 (or sleeve gripping pads 134) contacting inner rim 304. The shape and design of spring 108, and adjustable toilet seat riser 100, is that sleeves 132 are wider than inner rim 304 when adjustable toilet seat riser 100 is in a relaxed, uncompressed state.

Figure 26:
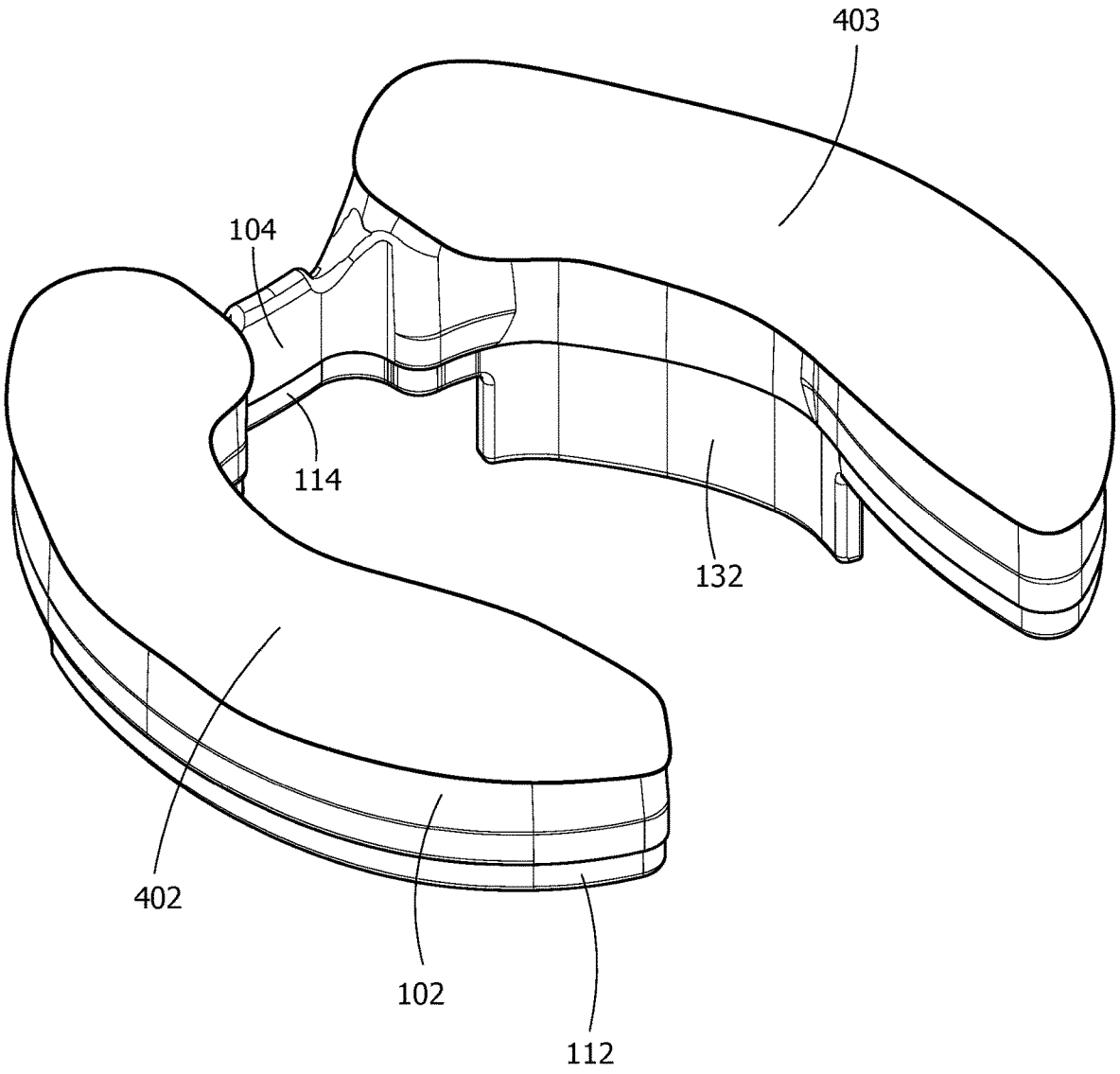
FIG. 26 is a top perspective view of the adjustable toilet seat riser in FIG. 1, with a soft top installed on the assembled arms.
Figure 27:
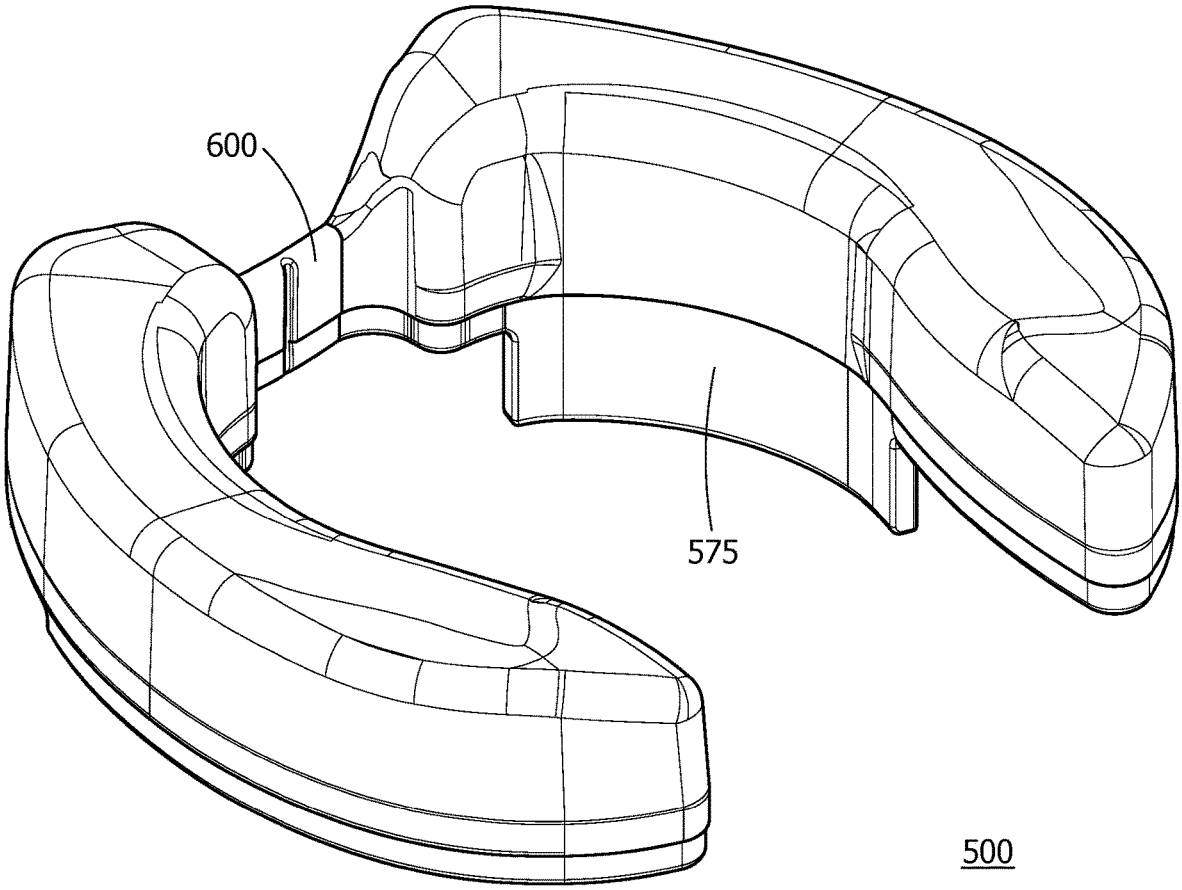
FIG. 27 is front top perspective view of a second embodiment of a coupling adjustable toilet seat riser.
Figure 28:
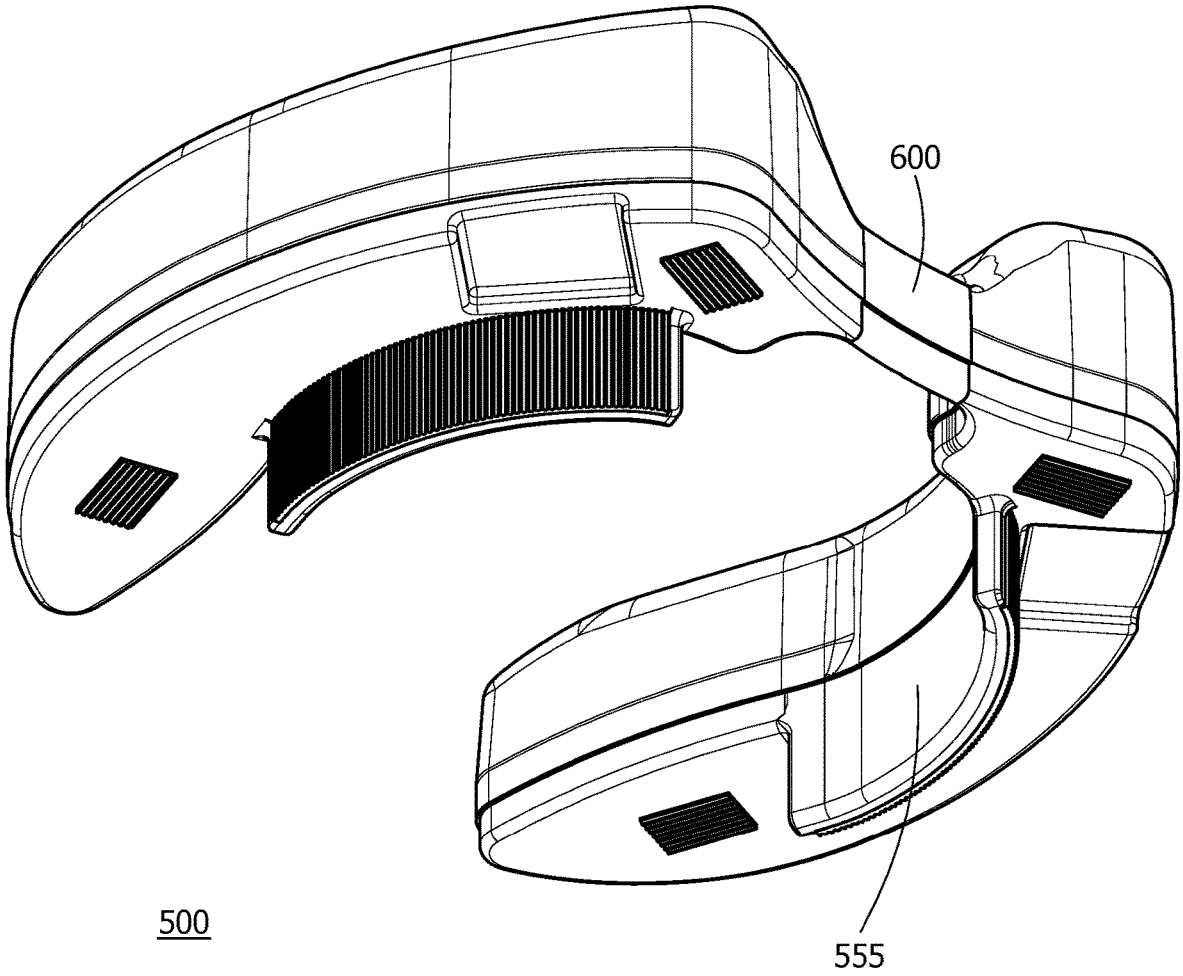
FIG. 28 is a rear bottom perspective view of the coupling adjustable toilet seat riser in FIG. 27.

FIG. 26 shows an adjustable toilet seat riser 100 with a left soft top 402 and right soft top 403 installed on top of the upper seat 102. Soft tops 402 403 are a soft layer to provide a cushion for the user while she sits on the adjustable toilet seat riser 100. Soft tops 402 403 are made using a secondary over mold injection process. Soft tops 402 403 are made from thermoplastic rubber (TPR), a synthetic, rubber-like elastomer.

Although numerous materials can be used, the preferred material for the adjustable toilet seat riser 100 is high-density polyethylene (HDPE). Adjustable toilet seat riser 100 is formed using a blow mold process, aside from notch gripping pads 122, sleeve gripping pads 134, fasteners 124, and spring 108 (which are all added after the blow mold process is complete).

Second Embodiment—Coupling Adjustable Toilet Seat Riser

FIGS. 27-29, 30*a*, 30*b*, 31-33 show a second embodiment of the instant invention as coupling adjustable toilet seat riser 500. Coupling adjustable toilet seat riser 500 includes left arm 510, right arm 530, left platform 550, right platform 570, and flexible coupling 600.

Figure 29:
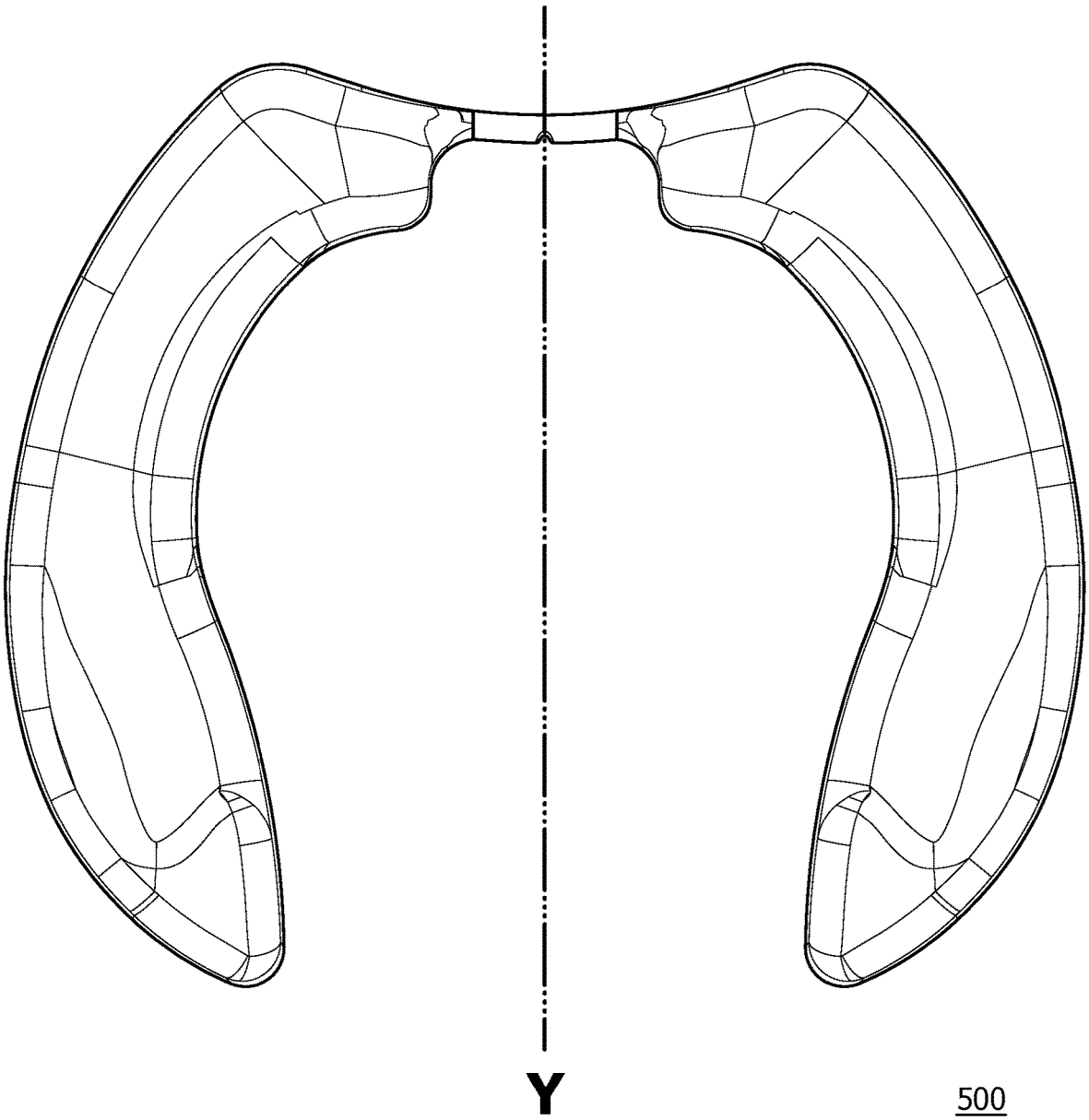
FIG. 29 is top view of the coupling adjustable toilet seat riser in FIG. 27.
Figure 31:
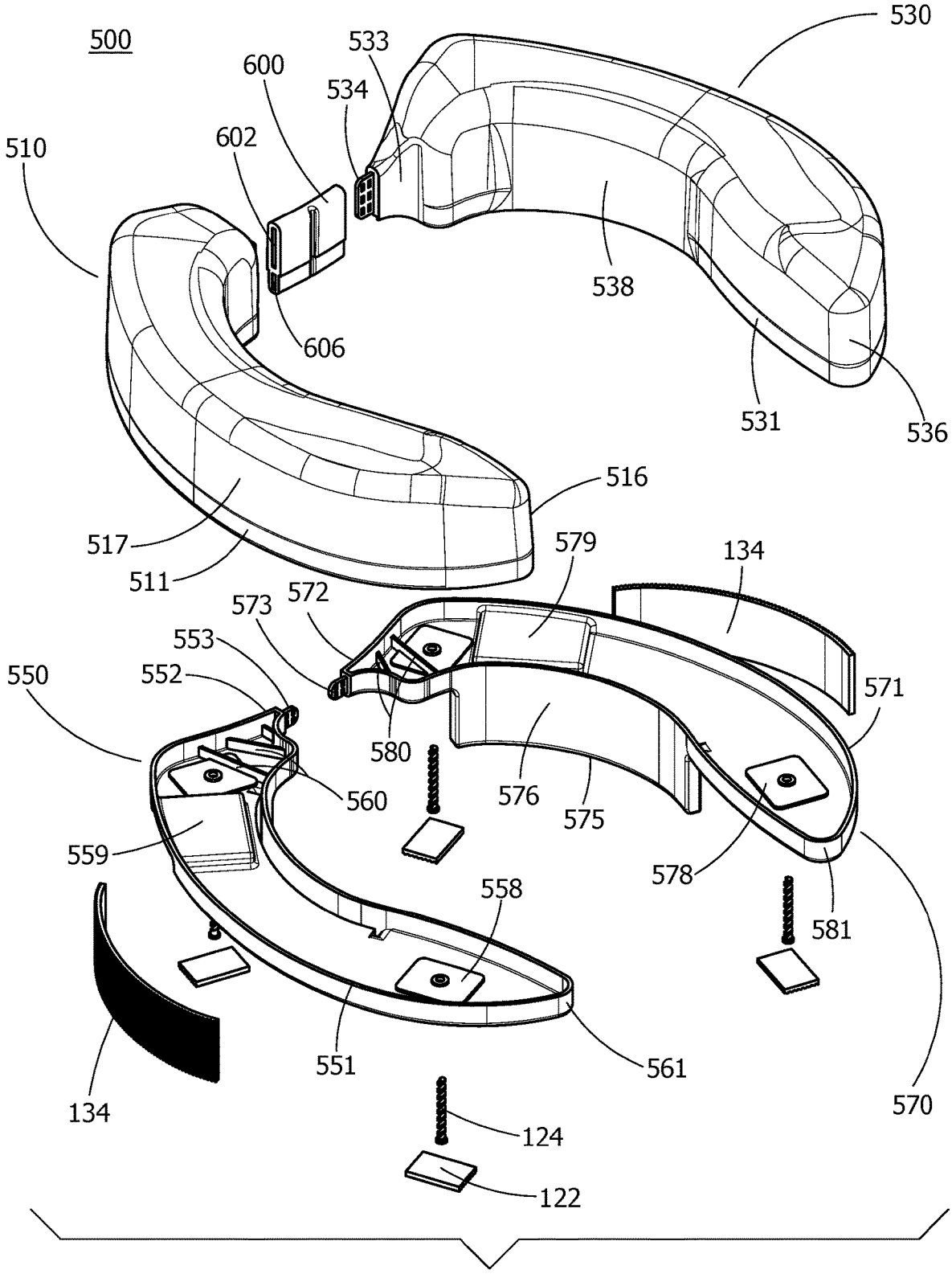
FIG. 31 is a front top perspective exploded view of the coupling adjustable toilet seat riser in FIG. 27.
Figure 32:
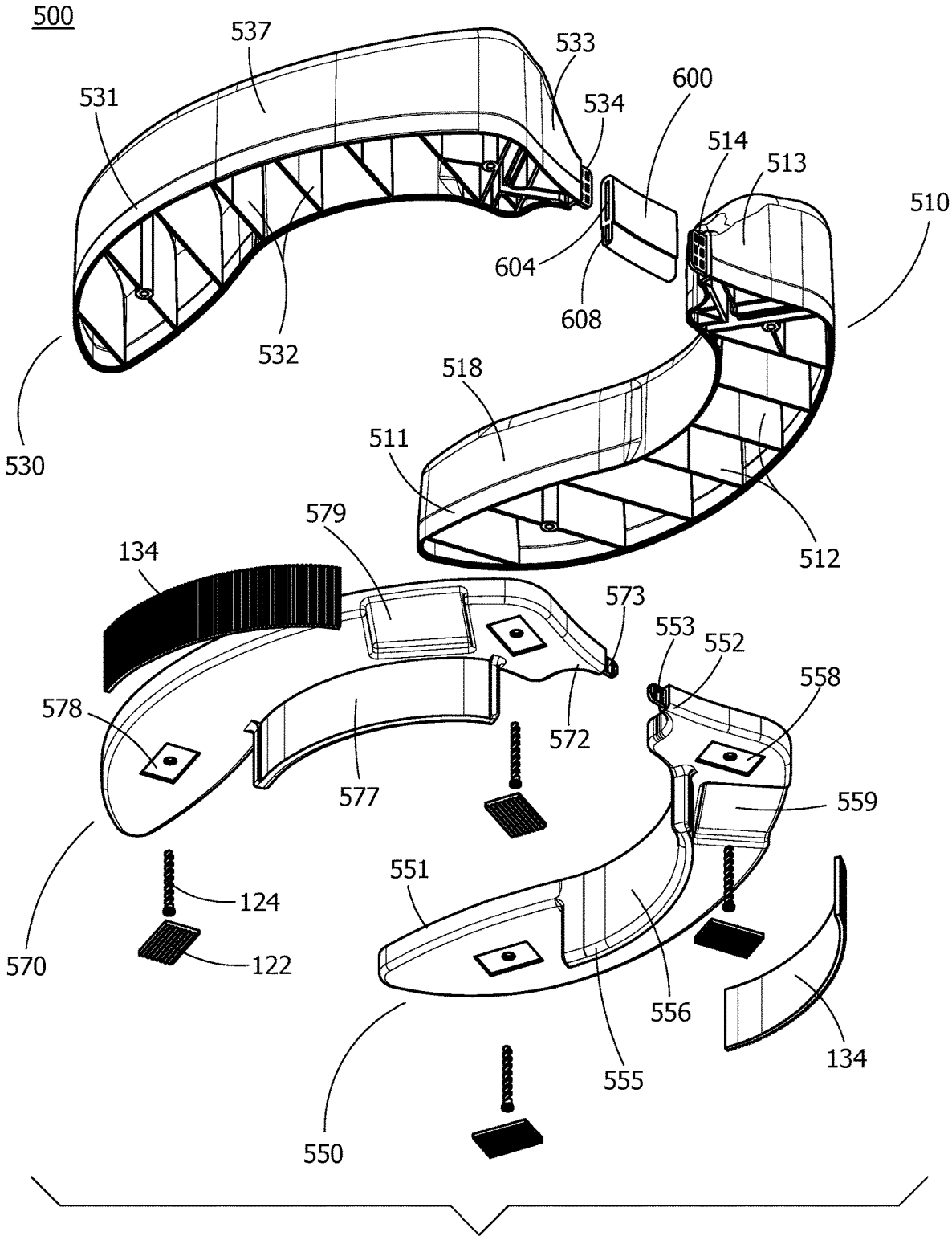
FIG. 32 is a rear bottom perspective exploded view of the coupling adjustable toilet seat riser in FIG. 27.

Left arm 510 and right arm 530 are mirror images of each other, i.e. the shape of left arm 510 is in an opposite orientation of the shape of right arm 530 relative to the Y axis going through coupling 600 (see FIG. 29). FIGS. 31 and 32 show the features of left arm 510, which includes left arm outer surface 517 and left arm inner surface 518. The bottom of left arm 510 includes left arm connection surface 511, which is designed to join to left platform connection surface 551. As pictured, left arm connection surface 511 is not continuous around the lower edge of left arm 510. In an exemplary embodiment, left arm connection surface 511 is continuous around the lower edge of left arm 510.

Figure 30A:
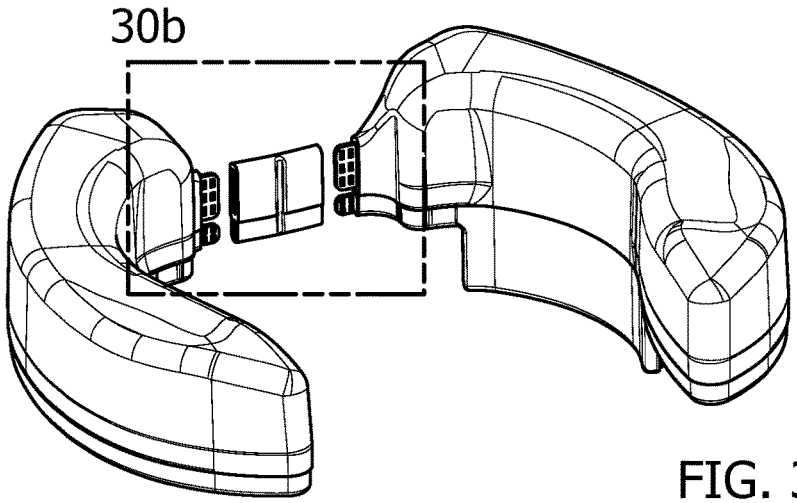
FIG. 30*a* is a front top perspective view of the coupling adjustable toilet seat riser in FIG. 27.
Figure 30B:
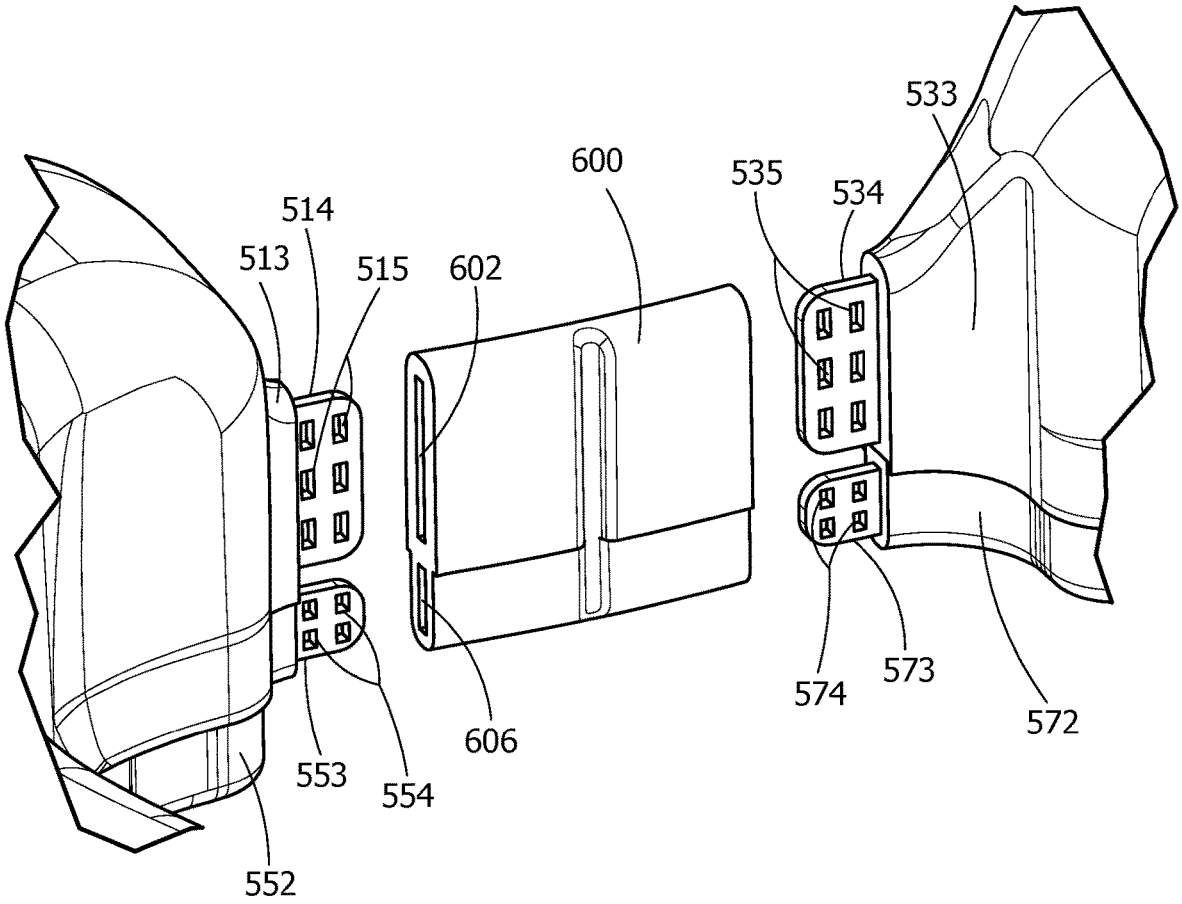
FIG. 30*b* is a zoomed in section of the flexible coupling and ribs of FIG. 30*a*.

As shown in FIG. 32, the inside of left arm 510 includes multiple left arm baffles 512 that increases the structural support of left arm 510. The end of left arm 510 is located at left arm end 516, which is the point of the left arm 510 towards the front of toilet 302. The opposite end of left arm 510 includes a tapered reduction to left arm flange 513. At the end of left arm flange 513 is left arm rib 514, which includes six left arm rib tabs 515. While six left arm rib tabs 515 are depicted in FIGS. 30*a* and 30*b*, only one left arm rib tab 515 is needed to secure left arm 510 to coupling 600. In an exemplary embodiment, an adhesive, male/female hooks, or other known fastening method is used to connect left arm rib 514 to flexible coupling 600 instead of left arm rib tabs 515.

FIGS. 31 and 32 show the features of right arm 530, which includes right arm outer surface 537 and right arm inner surface 538. The bottom of right arm 530 includes right arm connection surface 531 designed to join to right platform connection surface 571. As pictured, right arm connection surface 531 is not continuous around the lower edge of left arm 530. In an exemplary embodiment, right arm connection surface 531 is continuous around the lower edge of right arm 530.

The inside of right arm 530 includes multiple right arm baffles 532, which increases the structural support of right arm 530. The end of right arm 530 is located at right arm end 536, which is the point of the right arm 530 towards the front of toilet 302. The opposite end of right arm 530 includes a tapered reduction to right arm flange 533. At the end of right arm flange 533 is right arm rib 534, which includes six right arm rib tabs 535. While six right arm rib tabs 535 are depicted in FIGS. 30*a* and 30*b*, only one right arm rib tab 535 is needed to secure right arm 530 to coupling 600. In an exemplary embodiment, an adhesive, male/female hooks, or other known fastening method is used to connect right arm rib 534 to flexible coupling 600 instead of right arm rib tabs 535.

The top surfaces of left arm 510 and right arm 530 include rounded or contoured edges. These rounded edges reduce sharp edges on the top surface of the left arm 510 and right arm 530 where the user sits when sitting on the coupling adjustable toilet seat riser 500.

FIGS. 31 and 32 shows the features of left platform 550, which includes left platform connection surface 551, which is paired to connect with the profile of left arm connection surface 511. The back of left platform 550 includes a tapered reduction to form left platform flange 552. At the end of left platform flange 552 is left platform rib 553, which includes four left platform rib tabs 554. While four left platform rib tabs 554 are depicted in FIGS. 30*a* and 30*b*, only one left platform rib tab 554 is needed to secure left platform 550 to flexible coupling 600. In an exemplary embodiment, an adhesive, male/female hooks, or other known fastening method is used to connect left platform rib 553 to flexible coupling 600 instead of left platform rib tabs 554.

The end of left platform 550 is located at left platform end 561, which is the point of the left platform 550 towards the front of toilet 302. The opposite end of left platform 550 includes left platform slot 559 and left platform struts 560, which add structure support to left platform 550. Left platform 550 also includes two left platform notches 558, which are the locations for fasteners 124 and notch gripping pads 122.

Left platform sleeve 555 extends downward from the inner surface of left platform 550. Left platform sleeve inner surface 556 defines the inside surface of the left platform sleeve 555. Left platform sleeve outer surface 557 (not pictured) engages with inner rim 304 of toilet 302. In an exemplary embodiment, sleeve gripping pad 134 is secured to left platform sleeve outer surface 557 to engage with inner rim 304. Similar to adjustable toilet seat riser 100, sleeve gripping pads 134 create friction between coupling adjustable toilet seat riser 500 and toilet 302.

FIGS. 31 and 32 show the features of right platform 570, which includes right platform connection surface 571, which is paired to connect with the profile of right arm connection surface 531. The back of right platform 570 includes a tapered reduction to form right platform flange 572. At the end of right platform flange 572 is right platform rib 573, which includes four right platform rib tabs 574. While four right platform rib tabs 574 are depicted in FIGS. 30*a* and 30*b*, only one right platform rib tab 574 is needed to secure right platform 570 to flexible coupling 600. In an exemplary embodiment, an adhesive, male/female hooks, or other known fastening method is used to connect right platform rib 573 to flexible coupling 600 instead of right platform rib tabs 574.

The end of right platform 570 is located at right platform end 581, which is the point of the right platform 570 towards the front of toilet 302. The opposite end of right platform 570 includes right platform slot 579 and right platform struts 580, which add structure support to right platform 570. Right platform 570 also includes two right platform notches 578, which are the locations for fasteners 124 and notch gripping pads 122.

Right platform sleeve 575 extends downward from the inner surface of right platform 570. Right platform sleeve inner surface 576 defines the inside surface of the right platform sleeve 575. Right platform sleeve outer surface 577 engages with inner rim 304 of toilet 302. In an exemplary embodiment, sleeve gripping pad 134 is secured to right platform sleeve outer surface 577 to engage with inner rim 304. Similar to the installation of adjustable toilet seat riser 100 to toilet 302 in FIGS. 20-25, sleeve gripping pads 134 create friction between coupling adjustable toilet seat riser 500 of coupling adjustable toilet seat riser 500 and toilet 302.

FIGS. 30*a* and 30*b* show left arm rib 514, right arm rib 534, left platform rib 553, and right platform rib 773 prior to engagement with flexible coupling 600. Left arm rib 514 includes six left arm rib tabs 515. Right arm rib 534 includes six right arm rib tabs 535. Left platform rib 553 includes four left platform rib tabs 554. Right platform rib 773 includes four right platform rib tabs 574. Any number of respective rib tabs can be used on the respective ribs.

As shown in FIGS. 30*a* and 30*b*, to assemble coupling adjustable toilet seat riser 500: left arm rib 514 is inserted into left arm coupling opening 602; right arm rib 534 is inserted into right arm coupling opening 604 (not pictured); left platform rib 553 is inserted into left platform coupling opening 606; and right platform rib 773 is inserted into right platform coupling opening 608 (not pictured). When assembled, the respective rib tabs (515, 535, 554, 574) engage inside the respective openings (602, 604, 606, 608) to secure left arm 510, right arm 530, left platform 550, and right platform 570 to flexible coupling 600.

The flexible coupling 600 of coupling adjustable toilet seat riser 500 performs a similar function as assembled bridge 406 of adjustable toilet seat riser 100 in allowing the assembled toilet seat riser to be compressed inward for placement on toilet 302. Specifically, securing coupling adjustable toilet seat riser 500 onto toilet 302 by engaging left platform sleeve 555 and right platform sleeve 575 to inner rim 304. As shown in FIG. 30*b*, flexible coupling 600 includes a vertical indentation on its front surface that helps with the elastic flexibility of flexible coupling 600 while being flexed during installation on toilet 302.

The use of flexible coupling 600 along with left arm rib 514, right arm rib 534, left platform rib 553, and right platform rib 773 creates a live hinge in coupling adjustable toilet seat riser 500. A live hinge is defined as the section of the coupling adjustable toilet seat riser 500 that elastically flexes when a user presses left arm 510 (when assembled with left platform 530) and right arm 530 (when assembled with right platform 570) inward, and which flexes back towards its natural state when the force by the user is removed. The live spring is the ability of the flexible coupling 600 to flex in conjunction with left arm rib 514, right arm rib 534, left platform rib 553, and right platform rib 773. The live spring action of flexible coupling 600 performs a similar function as the live spring action of assembled bridge 406 of adjustable toilet seat riser 100.

Figure 33:
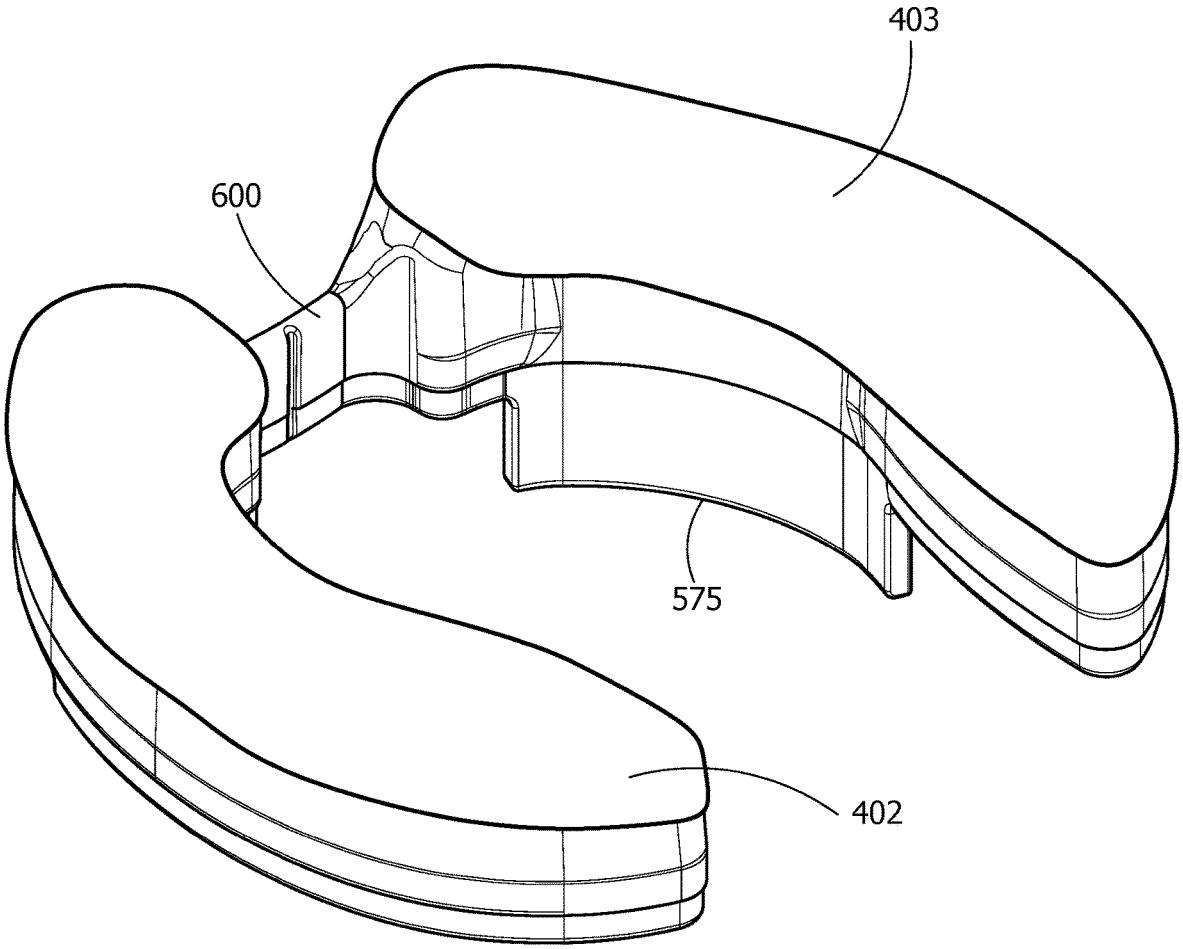
FIG. 33 is a front perspective view of the coupling adjustable toilet seat riser in FIG. 27, with soft tops installed on the left arm and right arm.
Figure 34:
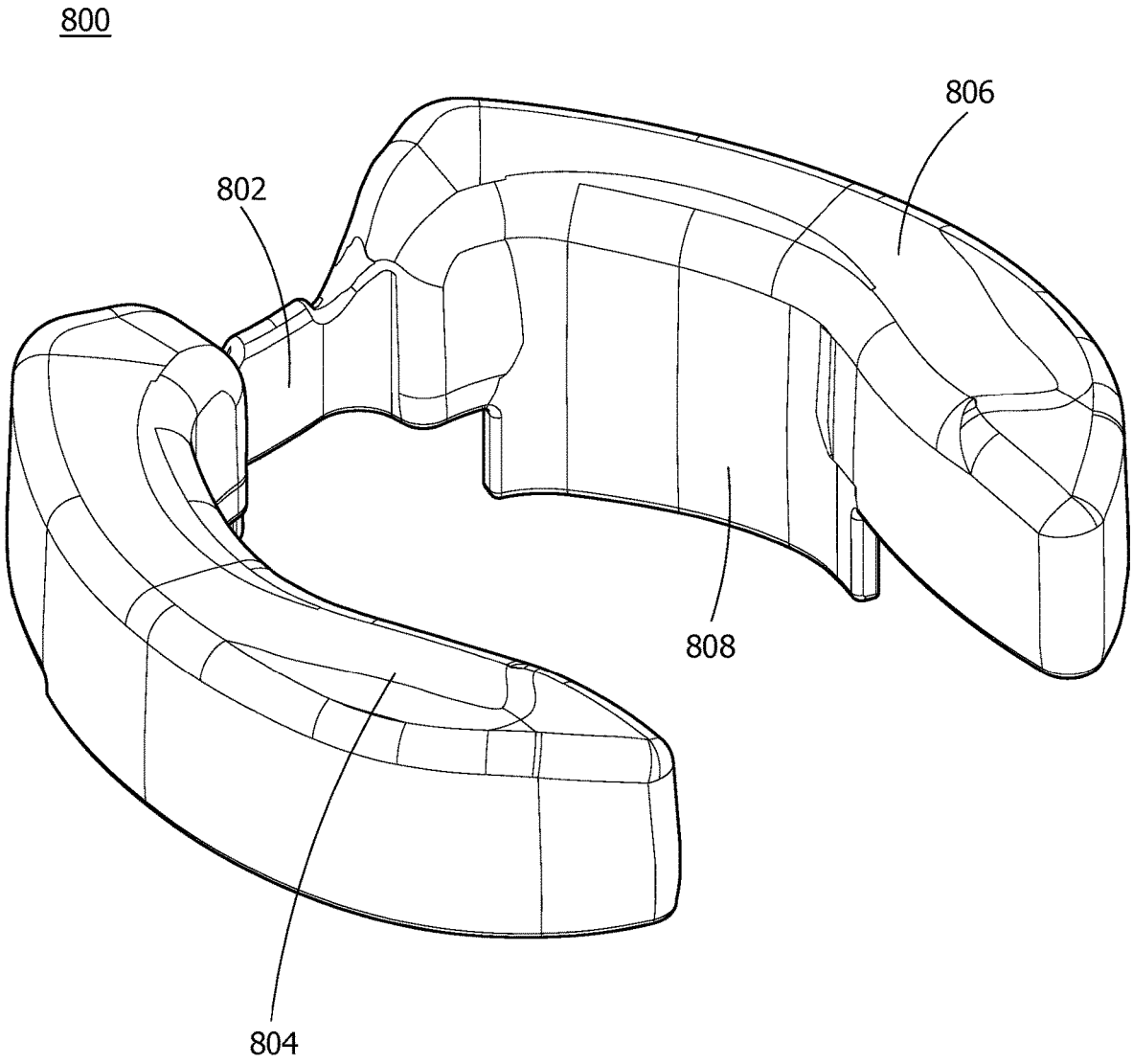
FIG. 34 is a front top perspective view of a third embodiment of a unitary adjustable toilet seat riser.
Figure 35:
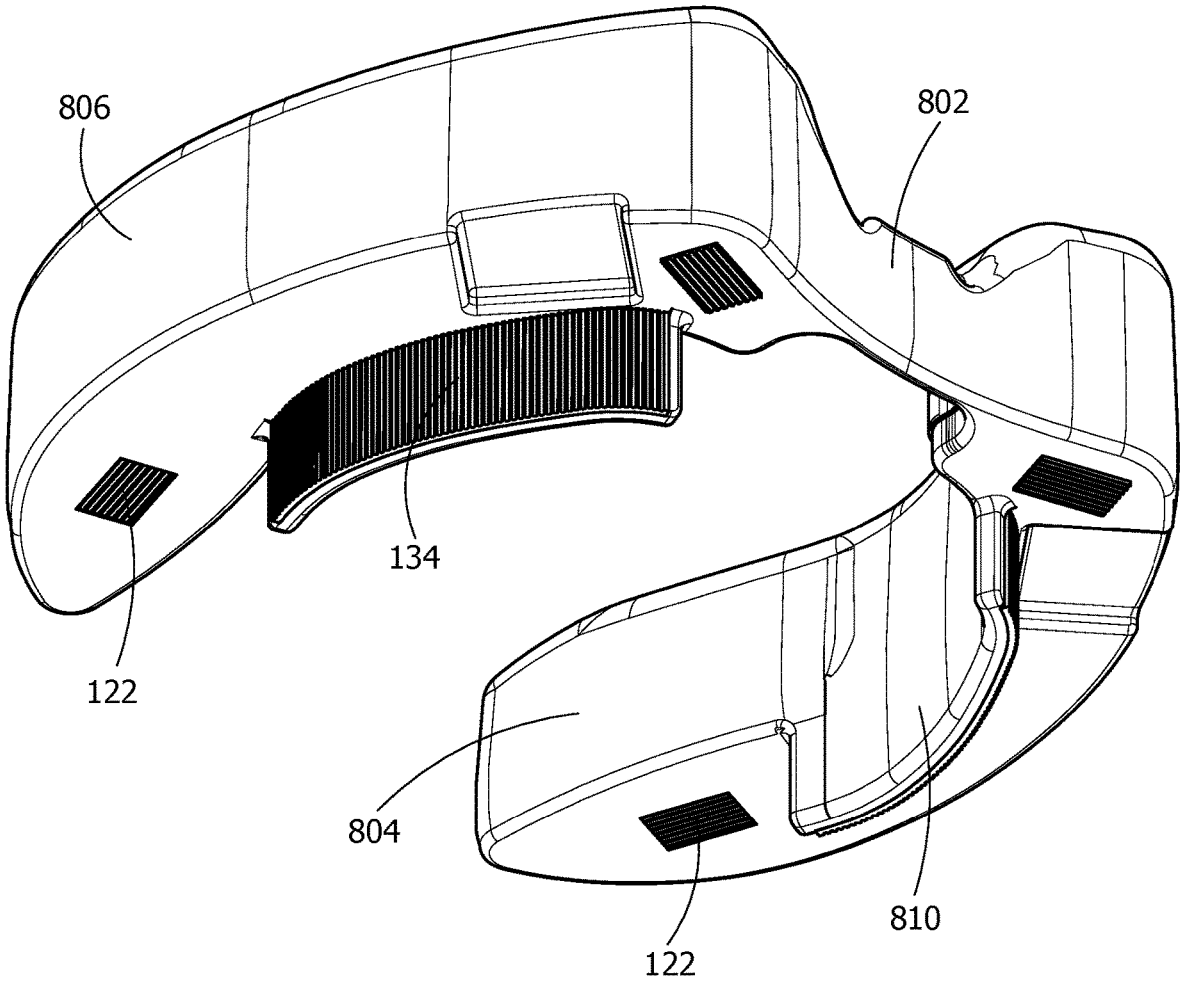
FIG. 35 is a rear bottom perspective view of the unitary adjustable toilet seat riser in FIG. 34.
Figure 36A:
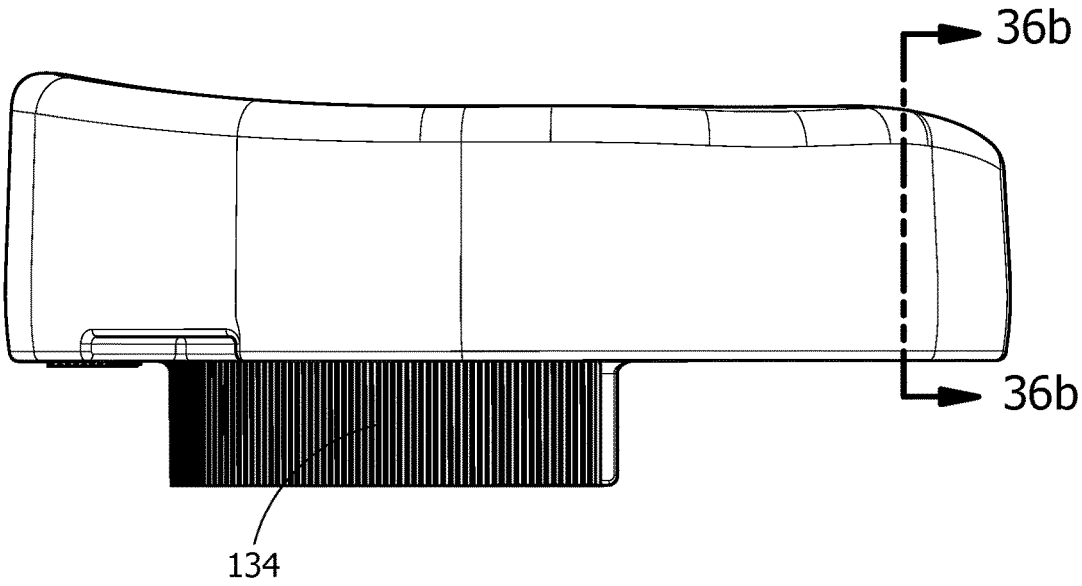
FIG. 36*a* is a left side view of the unitary adjustable toilet seat riser in FIG. 34.
Figure 36B:
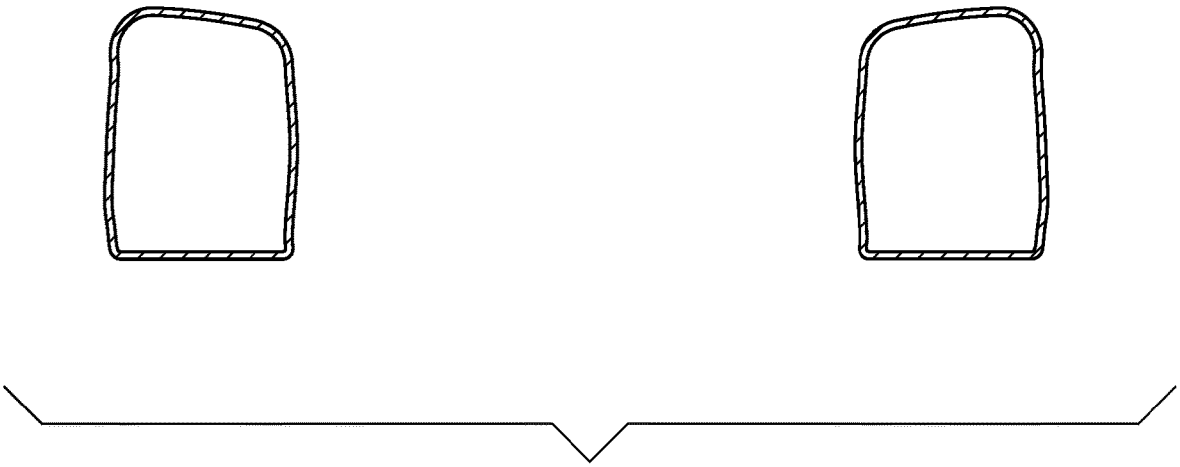
FIG. 36*b* is a front cross-sectional view of the unitary adjustable toilet seat riser in FIG. 34.

FIG. 33 shows coupling adjustable toilet seat riser 500 with a soft top 402 installed on top of the left arm 510 and soft top 403 installed on right arm 530. Notches 120, notch gripping pads 122, fasteners 124, fasteners holes 126, fastener inserts 128 are similar on coupling adjustable toilet seat riser 500 as used on adjustable toilet seat riser 100.

Third Embodiment—Unitary Toilet Seat Riser

FIGS. 34, 35, 36*a*, 36*b*, and 37 show a third embodiment of the instant invention as unitary adjustable toilet seat riser 800. Unitary adjustable toilet seat riser 800 is similar to adjustable toilet seat riser 100 except that unitary adjustable toilet seat riser 800 is a single formed seat riser. The spring 108 component is formed internally as part of the internal structure of the unitary adjustable toilet seat riser 800. Instead of an upper seat 102 and lower platform 112 that are joined in adjustable toilet seat riser 100, unitary adjustable toilet seat riser 800 is a singularly formed unit.

Unitary bridge 802 acts as the live hinge in the unitary toilet seat riser 800. A live hinge is defined as the section of the unitary toilet seat riser 800 that elastically flexes when a user presses left unitary arm 804 and right unitary arm 806 inward. Unitary bridge also flexes back towards its natural state when the force by the user on left unitary arm 804 and right unitary arm 806 is removed. The live spring is the ability of the unitary bridge 802 to elastically flex.

Unitary adjustable toilet seat riser 800 fits onto toilet 302 similar to the installation of adjustable toilet seat riser 100 onto toilet 302 (FIGS. 20-25) and coupling adjustable toilet seat riser 500 onto toilet 302. Right unitary sleeve 808 and left unitary sleeve 810 (with or without sleeve gripping pads 134) are positioned within the toilet 302 after the user exerts inward force on left unitary arm 804 and right unitary arm 806. When the user relaxes the force on left unitary arm 804 and right unitary arm 806, the outer surface of right unitary sleeve 808 and left unitary sleeve 810 (with or without sleeve gripping pads 134) engage with inner rim 304.

Figure 37:
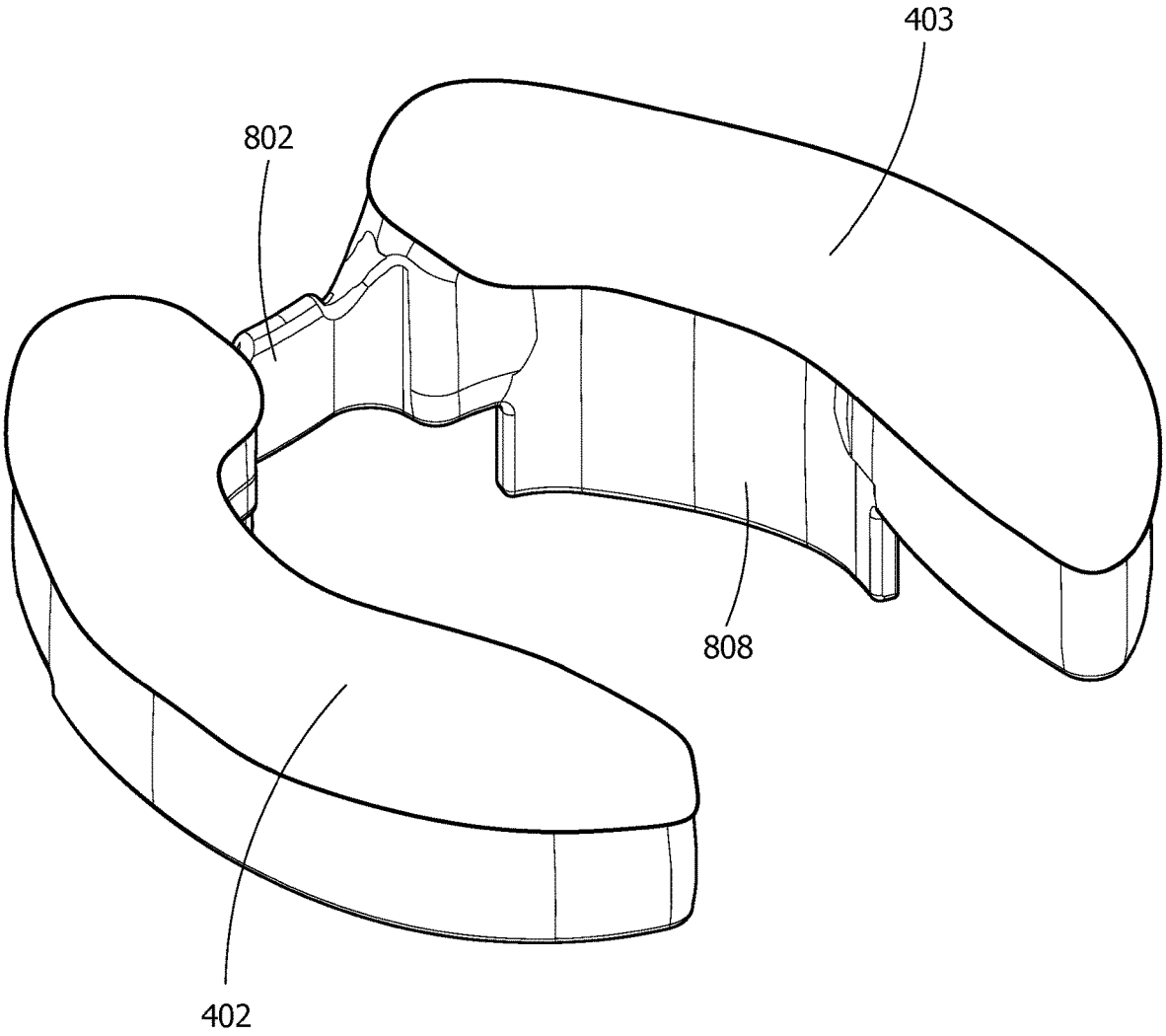
FIG. 37 is a front top perspective view of the unitary adjustable toilet seat riser in FIG. 34, with a soft top installed.

Similar to adjustable toilet seat riser 100 and coupling adjustable toilet seat riser 500, left unitary arm 804 and right unitary arm 806 include left soft top 402 and right soft top 403, as depicted in FIG. 37.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

The invention claimed is:

1. An adjustable toilet seat riser, comprising:

an upper seat formed from a single contiguous material;

a lower platform with at least one sleeve formed from a single contiguous material; and a flat spring, wherein the flat spring is internally positioned in the upper seat and the lower platform when the upper seat is secured to the lower platform and the adjustable toilet seat riser is flexible relative to the flat spring, wherein:

the flat spring has a plurality of bends;

the flat spring is flexible at an upper seat bridge of the upper seat and a lower platform bridge of the lower platform; and the upper seat is secured to the lower platform by aligning the profile of an upper seat connection surface with the profile of a lower platform connection surface.

2. The adjustable toilet seat riser recited in claim 1, wherein the upper seat is secured to the lower platform using fasteners.

3. The adjustable toilet seat riser recited in claim 2, wherein the fasteners are located at notches in the lower platform.

4. The adjustable toilet seat riser recited in claim 1, wherein the at least one sleeve extends downward from the lower platform.

5. The adjustable toilet seat riser recited in claim 1, further comprising at least one sleeve gripping pad on the at least one sleeve.

6. The adjustable toilet seat riser recited in claim 1, further comprising at least one notch gripping pad on the bottom surface of the lower platform.

7. The adjustable toilet seat riser recited in claim 1, further comprising at least one upper seat baffle in the upper seat.

8. The adjustable toilet seat riser recited in claim 1, further comprising at least one protrusion in lower platform.

9. The adjustable toilet seat riser recited in claim 1, further comprising an upper seat spring housing of the upper seat.

10. The adjustable toilet seat riser recited in claim 1, further comprising a lower platform spring housing of the lower platform.

11. The adjustable toilet seat riser recited in claim 1, wherein:

the flat spring is positioned in an upper seat spring housing of the upper seat and a lower platform spring housing of the lower platform.

12. An adjustable toilet seat riser, comprising:

a flat spring having a plurality of bends positioned within an assembled bridge at the rear portion of the adjustable toilet seat riser;

at least one sleeve on the inner portion of the adjustable toilet seat riser; and two arms extend from the assembled bridge, wherein:

the two arms and the assembled bridge are formed from a single contiguous material;

the two arms and the assembled bridge are formed from an upper seat is secured to a lower platform by aligning the profile of an upper seat connection surface with the profile of a lower platform connection surface; and the adjustable toilet seat riser is flexible at the assembled bridge.

13. The adjustable toilet seat riser recited in claim 12, further comprising at least one sleeve gripping pad on the at least one sleeve.

14. The adjustable toilet seat riser recited in claim 12, further comprising at least one notch gripping pad on the bottom surface of the adjustable toilet seat riser.

15. A method of installing an adjustable toilet seat riser on a toilet, comprising:

compressing two assembled arms relative to an assembled bridge, wherein:

the two assembled arms and the assembled bridge are formed from a single contiguous material;

the two arms and the assembled bridge are formed from an upper seat is secured to a lower platform by aligning the profile of an upper seat connection surface with the profile of a lower platform connection surface;

a flat spring with a plurality of bends is positioned within the assembled bridge;

relaxing the two arms of the adjustable toilet seat riser when positioned on a toilet; and engaging at least one sleeve on the adjustable toilet seat riser to an inner rim of the toilet.

16. The method recited in claim 15, wherein the at least one sleeve extends downward from the adjustable toilet seat riser.

* * * * *